US008055506B2

(12) United States Patent
Lee et al.

(10) Patent No.: US 8,055,506 B2
(45) Date of Patent: Nov. 8, 2011

(54) AUDIO ENCODING AND DECODING APPARATUS AND METHOD USING PSYCHOACOUSTIC FREQUENCY

(75) Inventors: Geon-hyoung Lee, Hwaseong-si (KR); Jae-one Oh, Yongin-si (KR); Chul-woo Lee, Suwon-si (KR); Jong-hoon Jeong, Suwon-si (KR); Nam-suk Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 952 days.

(21) Appl. No.: 12/023,410

(22) Filed: Jan. 31, 2008

(65) Prior Publication Data

US 2008/0195398 A1 Aug. 14, 2008

(30) Foreign Application Priority Data

Feb. 12, 2007 (KR) ..... 10-2007-0014558

(51) Int. Cl.
*G10L 11/04* (2006.01)

(52) U.S. Cl. ..... 704/500; 704/207

(58) Field of Classification Search ..... None
See application file for complete search history.

(56) References Cited

U.S. PATENT DOCUMENTS

| | | | | |
|---|---|---|---|---|
| 6,052,658 | A * | 4/2000 | Wang et al. | 704/205 |
| 2006/0015328 | A1 * | 1/2006 | Van Schijndel et al. | 704/219 |
| 2007/0016417 | A1 | 1/2007 | Sung et al. | |
| 2007/0112560 | A1 | 5/2007 | Gerrits et al. | |
| 2009/0274210 | A1 | 11/2009 | Grill et al. | |

FOREIGN PATENT DOCUMENTS

| | | | |
|---|---|---|---|
| KR | 10-2005-0007312 | A | 1/2005 |
| KR | 10-2006-0037375 | A | 5/2006 |
| KR | 10-2006-0121973 | A | 11/2006 |
| WO | 2005/078707 | A1 | 8/2005 |
| WO | 2006/000952 | A1 | 1/2006 |
| WO | 2006/030340 | A2 | 3/2006 |

OTHER PUBLICATIONS

Korean Office Action, dated Apr. 14, 2011, issued in Application No. 10-2007-0014558.

* cited by examiner

*Primary Examiner* — Talivaldis Ivars Smits
(74) *Attorney, Agent, or Firm* — Sughrue Mion, PLLC

(57) ABSTRACT

Provided is an audio encoding and decoding apparatus and method for improving a compression ratio while maintaining sound quality when sinusoidal waves of an audio signal are connected and encoded. The audio encoding method includes connecting sinusoidal waves of an input audio signal, converting a frequency of each of the connected sinusoidal waves to a psychoacoustic frequency, performing a first encoding operation for encoding the psychoacoustic frequency, performing a second encoding operation for encoding an amplitude of each of the connected sinusoidal waves, and outputting an encoded audio signal comprising the encoding result of the first encoding operation and the encoding result of the second encoding operation.

18 Claims, 17 Drawing Sheets

AUDIO ENCODING AND DECODING APPARATUS AND METHOD USING PSYCHOACOUSTIC FREQUENCY

CROSS-REFERENCE TO RELATED PATENT APPLICATION

This application claims priority from Korean Patent Application No. 10-2007-0014558, filed on Feb. 12, 2007, in the Korean Intellectual Property Office, the disclosure of which is incorporated herein in its entirety by reference.

BACKGROUND OF THE INVENTION

1. Field of the Invention

Apparatuses and methods consistent with the present invention relate to audio encoding and decoding, and more particularly, to connecting and encoding sinusoidal waves of an audio signal.

2. Description of the Related Art

Parametric coding is a method of segmenting an input audio signal by a specific length in a time domain and extracting sinusoidal waves with respect to the segmented audio signals. As a result of the extraction of the sinusoidal waves, if sinusoidal waves having similar frequencies are continued over several segments in the time domain, the sinusoidal waves having similar frequencies are connected and encoded using the parametric coding.

When connecting and encoding the sinusoidal waves having similar frequencies in the parametric coding, a frequency, a phase, and an amplitude of each of the sinusoidal waves are encoded first, and then a phase value and an amplitude difference of the connected sinusoidal wave are encoded.

When a phase value is encoded, in conventional parametric coding, a phase of a current segment is predicted from a frequency and phase of a previous segment (or a previous frame), and Adaptive Differential Pulse Code Modulation (ADPCM) of an error between the predicted phase and an actual phase of the current segment is performed. However, the ADPCM is a method of encoding a subsequent segment more finely using the same number of bits by decreasing an error signal measurement scale when the error is small.

Thus, when a frequency of an input audio signal is suddenly changed and an error signal measurement scale immediately before the frequency is changed is very small, a detected error may exceed a range that can be represented using bits of the ADPCM, and thus, a wrong encoding result may be obtained, resulting in a decrease in sound quality.

SUMMARY OF THE INVENTION

The present invention provides an audio encoding and decoding apparatus and method for improving a compression ratio with maintaining sound quality when sinusoidal waves of an audio signal are connected and encoded.

The present invention also provides an audio encoding and decoding apparatus and method for separating connected sinusoidal waves and unconnected sinusoidal waves from a plurality of segments and encoding and decoding the separated sinusoidal waves.

According to an aspect of the present invention, there is provided an audio encoding method including: connecting sinusoidal waves of an input audio signal; converting a frequency of each of the connected sinusoidal waves to a psychoacoustic frequency; performing a first encoding operation for encoding the psychoacoustic frequency; performing a second encoding operation for encoding an amplitude of each of the connected sinusoidal waves; and outputting an encoded audio signal by adding (i.e., including as part of the code)the encoding result of the first encoding operation and the encoding result of the second encoding operation.

The audio encoding method may further include detecting a difference between the psychoacoustic frequency and a frequency predicted based on a psychoacoustic frequency of a previous segment, wherein the first encoding operation includes encoding the difference instead of the psychoacoustic frequency.

The audio encoding method may further include: setting a quantization step size based on a masking level calculated using a psychoacoustic model of the input audio signal and the amplitudes of the connected sinusoidal waves; and quantizing the difference using the set quantization step size, wherein the first encoding operation includes encoding the quantized difference instead of the difference, and the outputting of the encoded audio signal includes outputting information on the quantization step size by processing the quantization step size as a control parameter.

The audio encoding method may further include: segmenting the input audio signal by a specific length; extracting sinusoidal waves from each of the segmented audio signals; comparing frequencies of the extracted sinusoidal waves and frequencies of sinusoidal waves extracted from an audio signal of a previous segment; if at least one sinusoidal wave among the extracted sinusoidal waves has a frequency that is not similar to a frequency of any sinusoidal wave extracted from the audio signal of the previous segment, as a result of the comparison, separating sinusoidal waves connected to the sinusoidal waves extracted from the audio signal of the previous segment and sinusoidal waves unconnected to the sinusoidal waves extracted from the audio signal of the previous segment from the extracted sinusoidal waves and encoding the separated sinusoidal waves, wherein the connecting of the sinusoidal waves, the converting of the frequency, the first encoding operation, the second encoding operation, and the outputting of the encoded audio signal are sequentially performed for the connected sinusoidal waves, and if the extracted sinusoidal waves have a frequency similar to the frequency of any sinusoidal wave extracted from the audio signal of the previous segment as a result of the comparison, the connecting of the sinusoidal waves, the converting of the frequency, the first encoding operation, the second encoding operation, and the outputting of the encoded audio signal are sequentially performed for the extracted sinusoidal waves.

According to another aspect of the present invention, there is provided an audio decoding method including: detecting an encoded psychoacoustic frequency and an encoded sinusoidal amplitude by parsing an encoded audio signal; performing a first decoding operation for decoding the encoded psychoacoustic frequency; converting the decoded psychoacoustic frequency to a sinusoidal frequency; performing a second decoding operation for decoding the encoded sinusoidal amplitude; detecting a sinusoidal phase based on the decoded sinusoidal amplitude and the sinusoidal frequency; and decoding a sinusoidal wave based on the detected sinusoidal phase, the decoded sinusoidal amplitude, and the sinusoidal frequency and decoding an audio signal using the decoded sinusoidal wave.

According to another aspect of the present invention, there is provided an audio encoding apparatus comprising: a segmentation unit segmenting an input audio signal by a specific length; a sinusoidal wave extractor extracting at least one sinusoidal wave from an audio signal output from the segmentation unit; a sinusoidal wave connector connecting the sinusoidal waves extracted by the sinusoidal wave extractor;

a frequency converter converting a frequency of each of the connected sinusoidal waves to a psychoacoustic frequency; a first encoder encoding the psychoacoustic frequency; a second encoder encoding an amplitude of each connected sinusoidal wave; and a adder outputting an encoded audio signal by adding the result encoded by the first encoder and the result encoded by the second encoder.

According to another aspect of the present invention, there is provided an audio decoding apparatus comprising: a parser parsing an encoded audio signal; a first decoder decoding an encoded psychoacoustic frequency output from the parser; an inverse frequency converter converting the decoded psychoacoustic frequency to a sinusoidal frequency; a second decoder decoding an encoded sinusoidal amplitude output from the parser; a phase detector detecting a sinusoidal phase based on the decoded sinusoidal amplitude and the sinusoidal frequency; and an audio decoder decoding a sinusoidal wave based on the detected sinusoidal phase, the decoded sinusoidal amplitude, and the sinusoidal frequency and decoding an audio signal using the decoded sinusoidal wave.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF EXEMPLARY EMBODIMENTS OF THE INVENTION

Hereinafter, the present invention will be described in detail by explaining exemplary embodiments of the invention with reference to the attached drawings.

Figure 1:
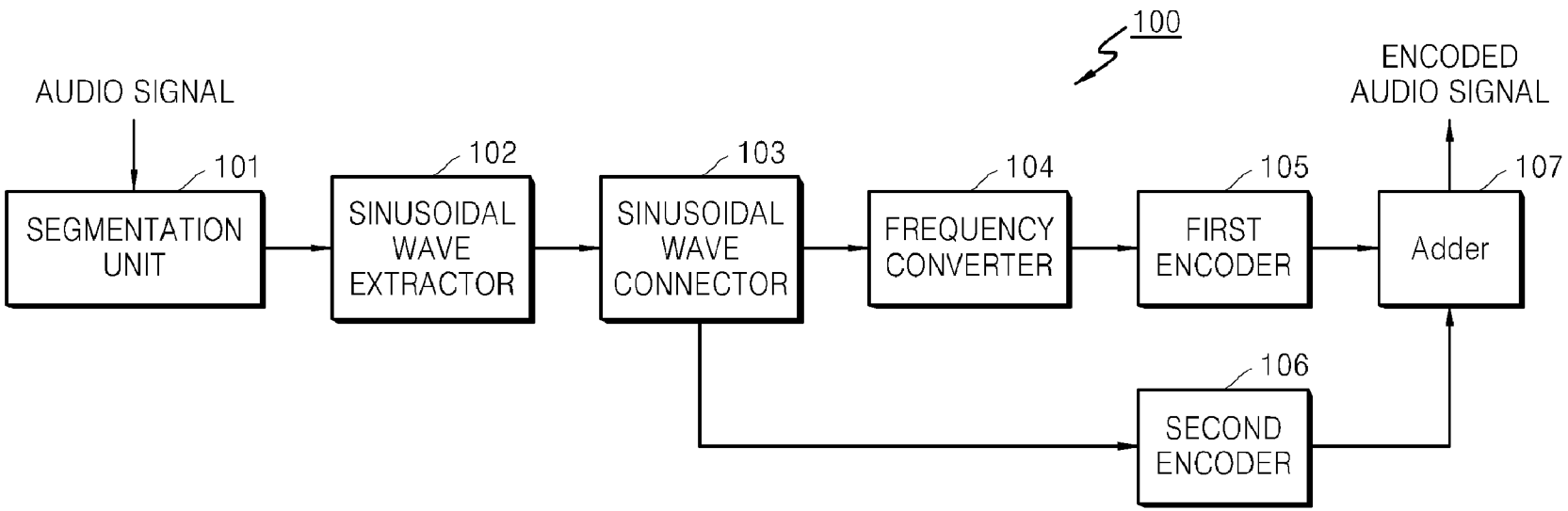
FIG. 1 is a block diagram of an audio encoding apparatus according to an exemplary embodiment of the present invention.

FIG. 1 is a block diagram of an audio encoding apparatus 100 according to an exemplary embodiment of the present invention. Referring to FIG. 1, the audio encoding apparatus 100 includes a segmentation unit 101, a sinusoidal wave extractor 102, a sinusoidal wave connector 103, a frequency converter 104, a first encoder 105, a second encoder 106, and a adder 107.

The segmentation unit 101 segments an input audio signal by a specific length L in a time domain, wherein the specific length L is an integer. Thus, if an audio signal output from the segmentation unit 101 is S(n), n is a temporal index and can be defined as n=1~L. When the input audio signal is segmented by the specific length L, the segmented audio signals may overlap with a previous segment by an amount of L/2 or by a specific length.

The sinusoidal wave extractor 102 extracts at least one sinusoidal wave from a segmented audio signal output from the segmentation unit 101 in a matching tracking method. That is, first, the sinusoidal wave extractor 102 extracts a sinusoidal wave having the greatest amplitude from the segmented audio signal S(n). Next, the sinusoidal wave extractor 102 extracts a sinusoidal wave having the second greatest amplitude from the segmented audio signal S(n). The sinusoidal wave extractor 102 can repeatedly extract a sinusoidal wave from the segmented audio signal S(n) until the extracted sinusoidal amplitude reaches a pre-set sinusoidal amplitude. The pre-set sinusoidal amplitude can be determined according to a target bit rate. However, the sinusoidal wave extractor 102 may extract sinusoidal waves from the segmented audio signal S(n) that do not set a pre-set sinusoidal amplitude.

The sinusoidal waves extracted by the sinusoidal wave extractor 102 can be defined by Formula 1.

$$a_i v_i(n) \tag{1}$$

In Formula 1, $a_i$ denotes an amplitude of an extracted sinusoidal wave, and $v_i$ is a sinusoidal wave represented by Formula 2, which has a frequency of $k_i$ and a phase of $\phi_i$.

$$v_i(n)=A\sin(2\pi k_i n/L+\phi_i) \tag{2}$$

In Formula 2, A denotes a normalization constant used to make the magnitude of $v_i(n)$ 1. In addition, i corresponds to the number of detected sinusoidal waves and is an index indicating a different sinusoidal wave. If the number of sinusoidal waves detected by the sinusoidal wave extractor 102 with respect to a single segment is K, i=1~K.

The sinusoidal wave connector 103 connects sinusoidal waves extracted from a currently segmented audio signal to sinusoidal waves extracted from a previously segmented audio signal based on frequencies of the sinusoidal waves extracted from the currently segmented audio signal and frequencies of the sinusoidal waves extracted from the previously segmented audio signal. The connection of the sinusoidal waves can be defined as frequency tracking.

Figure 2:
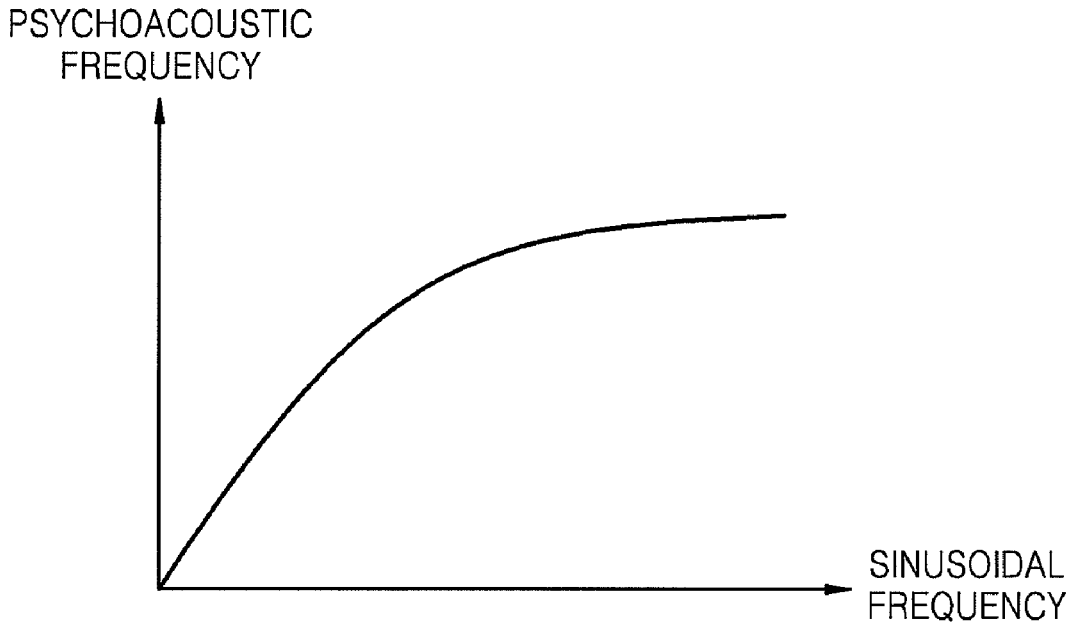
FIG. 2 illustrates a correlation between a sinusoidal frequency and a psychoacoustic frequency which is defined by a frequency converter illustrated in FIG. 1.

The frequency converter 104 converts a frequency of each of the connected sinusoidal waves to a psychoacoustic frequency. If a frequency of an audio signal is high, a person cannot perceive a correct frequency or a phase according to a psychoacoustic characteristic. Thus, in order to finely encode a lower frequency and not to finely encode a higher frequency, the frequency converter 104 defines a correlation between a sinusoidal frequency and a psychoacoustic frequency as illustrated in FIG. 2 and converts a frequency of each of the connected sinusoidal waves to a psychoacoustic frequency based on the definition. As illustrated in FIG. 2, as a sinusoidal frequency becomes higher, a variation range of a psychoacoustic frequency becomes smaller.

In addition, the frequency converter 104 can convert a frequency using an Equivalent Rectangular Band (ERB) scale, or a critical band scale including a bark band scale. When the ERB scale is used, the frequency converter 104 can output a psychoacoustic frequency S(f) by converting a sinusoidal frequency f using Formula 3.

$$S(f)=\log(0.00437\times f+1) \quad (3)$$

If the number of sinusoidal waves output from the sinusoidal wave connector 103 is K, the frequency converter 104 converts a frequency of each of the K sinusoidal waves to a psychoacoustic frequency.

The first encoder 105 encodes the psychoacoustic frequency. The second encoder 106 encodes the amplitude $a_i$ of each connected sinusoidal wave output from the sinusoidal wave connector 103. The first encoder 105 and the second encoder 106 can perform encoding using the Huffman coding method.

The adder 107 outputs an encoded audio signal by adding the encoded psychoacoustic frequency output from the first encoder 105 and the encoded amplitude output from the second encoder 106. The encoded audio signal can have a bitstream pattern.

Figure 3:
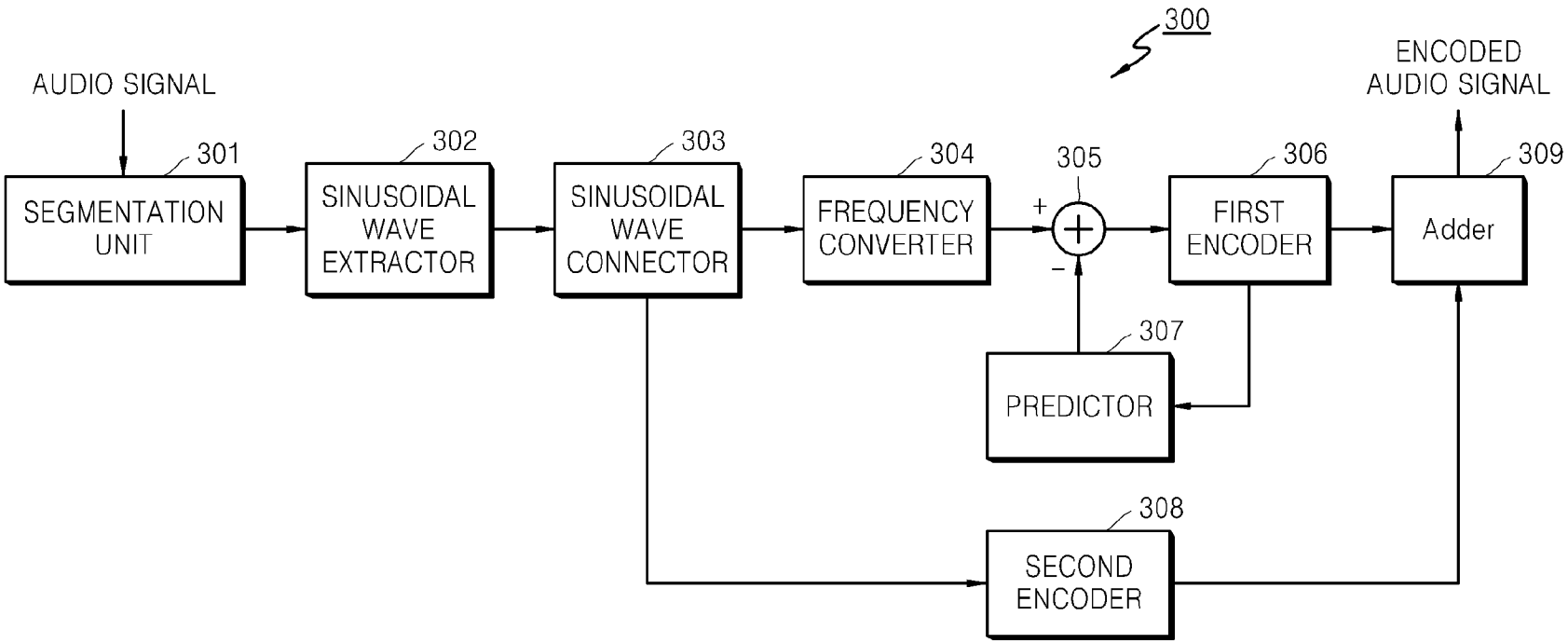
FIG. 3 is a block diagram of an audio encoding apparatus according to another exemplary embodiment of the present invention.

FIG. 3 is a block diagram of an audio encoding apparatus 300 according to another exemplary embodiment of the present invention. The audio encoding apparatus 300 illustrated in FIG. 3 includes a segmentation unit 301, a sinusoidal wave extractor 302, a sinusoidal wave connector 303, a frequency converter 304, a difference detector 305, a first encoder 306, a predictor 307, a second encoder 308, and a adder 309.

The audio encoding apparatus 300 illustrated in FIG. 3 is an exemplary embodiment in which a prediction function is added to the audio encoding apparatus 100 illustrated in FIG. 1. Thus, the segmentation unit 301, the sinusoidal wave extractor 302, the sinusoidal wave connector 303, the frequency converter 304, the second encoder 308, and the adder 309, which are included in the audio encoding apparatus 300, are configured and operate similarly to the segmentation unit 101, the sinusoidal wave extractor 102, the sinusoidal wave connector 103, the frequency converter 104, the second encoder 106, and the adder 107, which are included in the audio encoding apparatus 100 illustrated in FIG. 1, respectively.

Referring to FIG. 3, the difference detector 305 detects a difference between a frequency predicted based on a psychoacoustic frequency of a previous segment and a psychoacoustic frequency output from the frequency converter 304, and transmits the detected difference to the first encoder 306. If the number of predicted frequencies is K, the difference detector 305 detects the difference using a predicted frequency corresponding to the psychoacoustic frequency output from the frequency converter 304.

The first encoder 306 encodes the difference output from the difference detector 305. The first encoder 306 can encode the difference using the Huffman coding method. The first encoder 306 transmits the encoding result to the adder 309.

The predictor 307 predicts a psychoacoustic frequency of a current segment based on a psychoacoustic frequency before encoding, which is received from the first encoder 306. For example, since a subsequent psychoacoustic frequency has the greatest probability of being similar to a previous value, the previous value can be used as a predicted value. Thus, the predicted psychoacoustic frequency is provided to the difference detector 305 as the predicted frequency.

Figure 4:
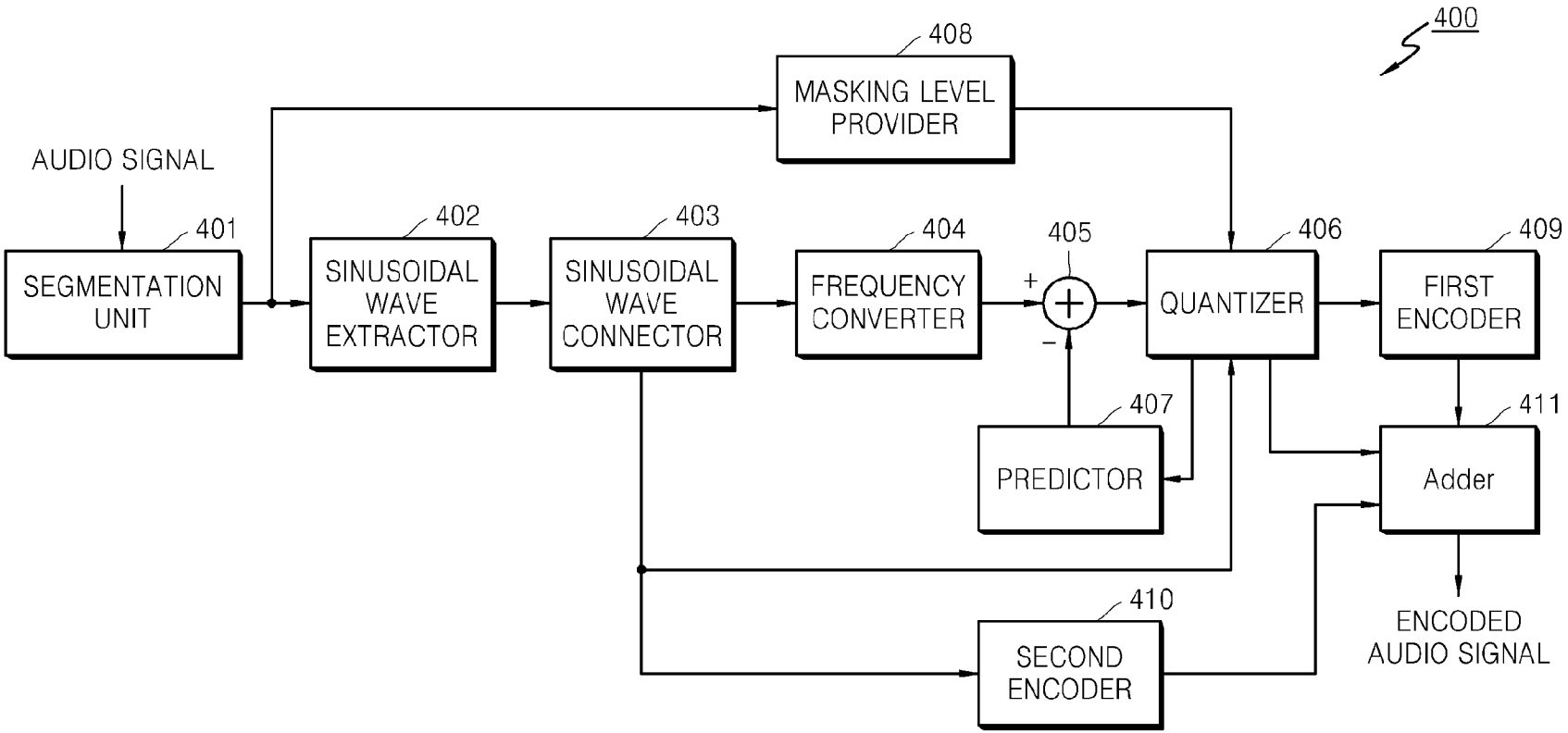
FIG. 4 is a block diagram of an audio encoding apparatus according to still another exemplary embodiment of the present invention.

FIG. 4 is a block diagram of an audio encoding apparatus 400 according to another exemplary embodiment of the present invention. The audio encoding apparatus 400 illustrated in FIG. 4 includes a segmentation unit 401, a sinusoidal wave extractor 402, a sinusoidal wave connector 403, a frequency converter 404, a difference detector 405, a quantizer 406, a predictor 407, a masking level provider 408, a first encoder 409, a second encoder 410, and a adder 411.

The audio encoding apparatus 400 illustrated in FIG. 4 is an exemplary embodiment in which a quantization function is added to the audio encoding apparatus 300 illustrated in FIG. 3. Thus, the segmentation unit 401, the sinusoidal wave extractor 402, the sinusoidal wave connector 403, the frequency converter 404, the difference detector 405, and the second encoder 410, which are included in the audio encoding apparatus 400 illustrated in FIG. 4, are configured and operate similarly to the segmentation unit 301, the sinusoidal wave extractor 302, the sinusoidal wave connector 303, the frequency converter 304, the difference detector 305, and the second encoder 308, which are included in the audio encoding apparatus 300 illustrated in FIG. 3, respectively.

Referring to FIG. 4, the masking level provider 408 calculates a masking level based on a psychoacoustic model of a currently segmented audio signal output from the segmentation unit 401 and provides the calculated masking level as a masking level of the currently segmented audio signal.

The quantizer 406 sets a quantization step size based on the masking level provided by the masking level provider 408 and an amplitude $a_i$ of each connected sinusoidal wave output from the sinusoidal wave connector 403. That is, if the amplitude $a^i$ of each connected sinusoidal wave is greater than the masking level, the quantizer 406 sets the quantization step size to be small, and if the amplitude $a_i$ of each connected sinusoidal wave is not greater than the masking level, the quantizer 406 sets the quantization step size to be large. The quantizer 406 quantizes the difference output from the difference detector 405 using the set quantization step size. The quantizer 406 also transmits the difference before quantization to the predictor 407 as a psychoacoustic frequency of a previous segment and transmits the set quantization step size to the adder 411.

The predictor 407 predicts a psychoacoustic frequency of a current segment based on the difference and provides the predicted frequency to the difference detector 405.

The first encoder 409 encodes the quantized difference signal output from the quantizer 406. The adder 411 adds the encoding result output from the first encoder 409, the second encoder 410 and the quantization step size output from the quantizer 406, and outputs the result of adding as an encoded audio signal. The quantization step size is added as a control parameter of the encoded audio signal.

Figure 5:
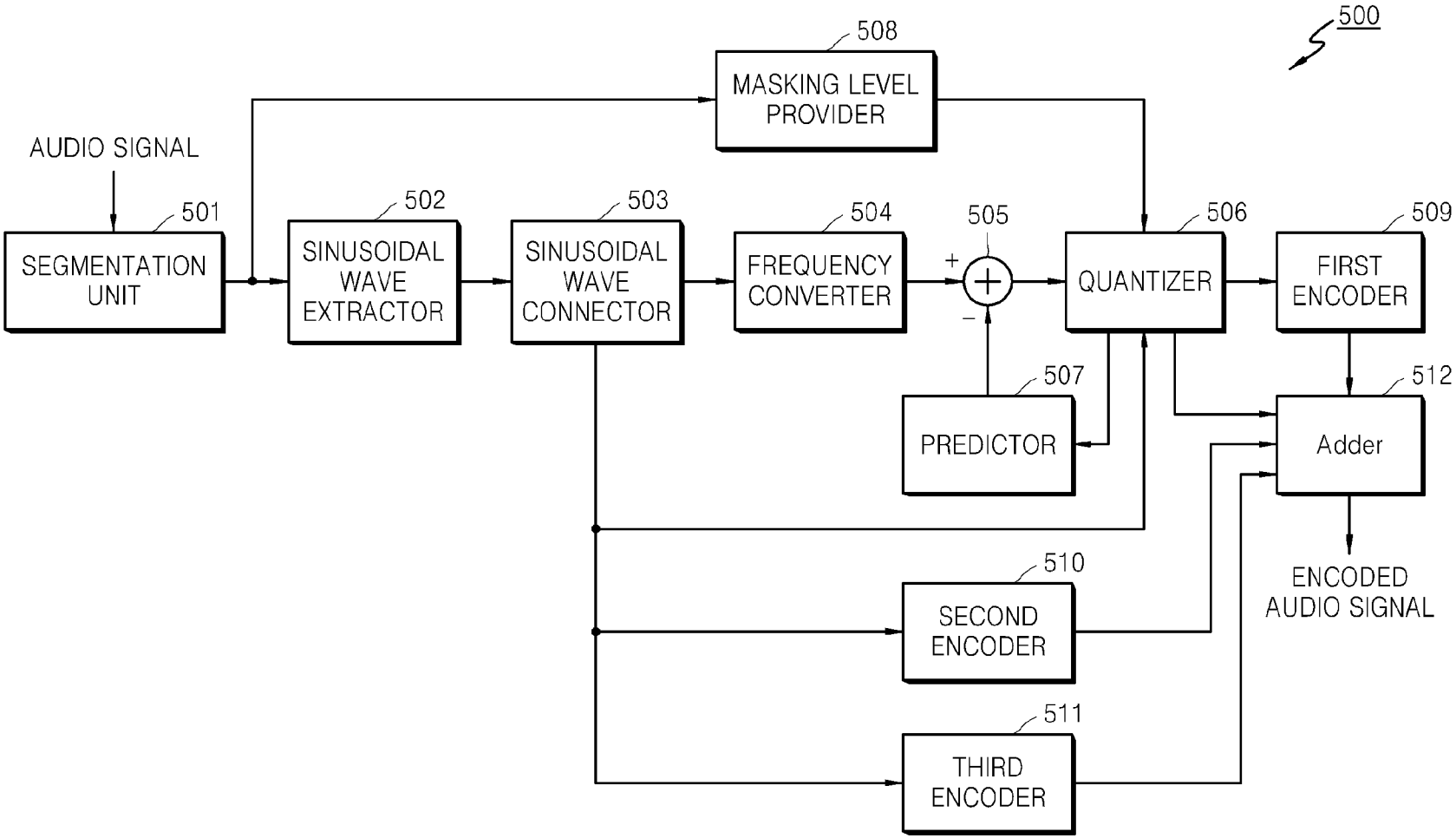
FIG. 5 is a block diagram of an audio encoding apparatus according to yet another exemplary embodiment of the present invention.

FIG. 5 is a block diagram of an audio encoding apparatus 500 according to another exemplary embodiment of the present invention. The audio encoding apparatus 500 illustrated in FIG. 5 includes a segmentation unit 501, a sinusoidal wave extractor 502, a sinusoidal wave connector 503, a frequency converter 504, a difference detector 505, a quantizer 506, a predictor 507, a masking level provider 508, a first encoder 509, a second encoder 510, a third encoder 511, and a adder 512.

The audio encoding apparatus 500 illustrated in FIG. 5 is an exemplary embodiment in which a function of performing encoding by distinguishing connected sinusoidal waves from unconnected sinusoidal waves is added to the audio encoding apparatus 400 illustrated in FIG. 4. Thus, the segmentation unit 501, the sinusoidal wave extractor 502, the frequency converter 504, the difference detector 505, the quantizer 506, the predictor 507, the masking level provider 508, the first encoder 509, and the second encoder 510, which are included in the audio encoding apparatus 500 illustrated in FIG. 5, are configured and operate similarly to the segmentation unit 401, the sinusoidal wave extractor 402, the frequency converter 404, the difference detector 405, the quantizer 406, the predictor 407, the masking level provider 408, the first encoder 409, and the second encoder 410, which are included in the audio encoding apparatus 400 illustrated in FIG. 4, respectively.

Referring to FIG. 5, the sinusoidal wave connector 503 compares frequencies of sinusoidal waves currently extracted by the sinusoidal wave extractor 502 and frequencies of sinusoidal waves extracted from an audio signal of a previous segment. If at least one of the currently extracted sinusoidal waves has a frequency that is not similar to the frequency of any sinusoidal wave extracted from the audio signal of the previous segment as a result of the comparison, the sinusoidal wave connector 503 transmits a frequency, phase, and amplitude of the sinusoidal wave having the dissimilar frequency to the third encoder 511. Among the currently extracted sinusoidal waves, for each sinusoidal wave that has a frequency similar to the frequency of any sinusoidal wave extracted from the audio signal of the previous segment, the sinusoidal wave connector 503 connects the sinusoidal wave to the sinusoidal wave extracted from the audio signal of the previous segment, transmits a frequency of the connected sinusoidal wave to the frequency converter 504, and transmits an amplitude of the connected sinusoidal wave to the second encoder 510.

The third encoder 511 encodes the frequency, phase, and amplitude of each sinusoidal wave received from the sinusoidal wave connector 503 that is not connected to any sinusoidal wave extracted from the audio signal of the previous segment.

The adder 512 adds encoding results output from the first encoder 509, the second encoder 510, the third encoder 511 and a quantization step size output from the quantizer 506, and outputs the adding result as an encoded audio signal.

The function of performing encoding by distinguishing connected sinusoidal waves from unconnected sinusoidal waves, which is defined by the audio encoding apparatus 500 illustrated in FIG. 5, can be added to the audio encoding apparatus 100 illustrated in FIG. 1 or the audio encoding apparatus 300 illustrated in FIG. 3. Thus, the sinusoidal wave connector 103 illustrated in FIG. 1 or the sinusoidal wave connector 303 illustrated in FIG. 3 can be implemented to be configured or operate similarly to the sinusoidal wave connector 503 illustrated in FIG. 5, and the audio encoding apparatus 100 illustrated in FIG. 1 or the audio encoding apparatus 300 illustrated in FIG. 3 can be implemented to further include the third encoder 511 illustrated in FIG. 5.

Figure 6:
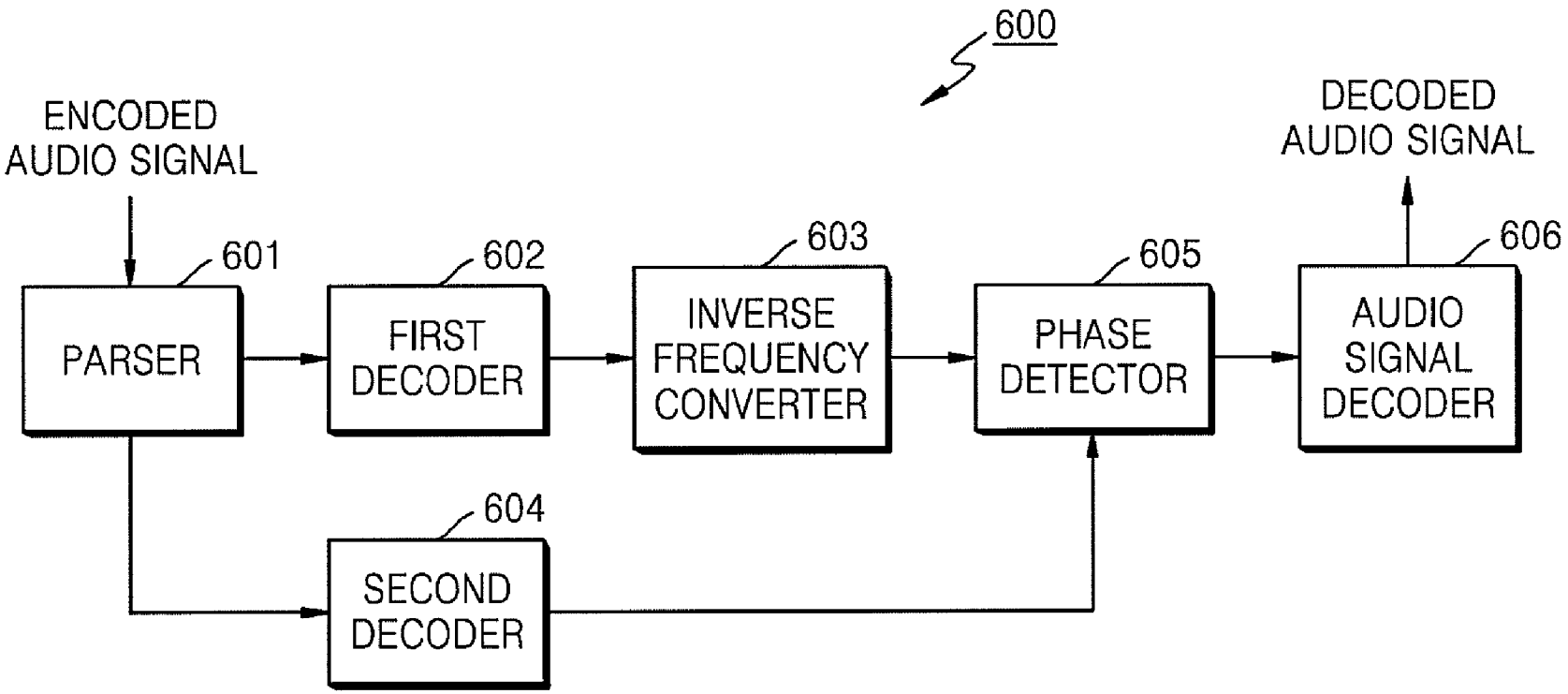
FIG. 6 is a block diagram of an audio decoding apparatus according to an exemplary embodiment of the present invention.

FIG. 6 is a block diagram of an audio decoding apparatus 600 according to an exemplary embodiment of the present invention. The audio decoding apparatus 600 illustrated in FIG. 6 includes a parser 601, a first decoder 602, an inverse frequency converter 603, a second decoder 604, a phase detector 605, and an audio signal decoder 606. The audio decoding apparatus 600 illustrated in FIG. 6 corresponds to the audio encoding apparatus 100 illustrated in FIG. 1.

Referring to FIG. 6, when an encoded audio signal is input, the parser 601 parses the input encoded audio signal. The input encoded audio signal may have a bitstream pattern. The parser 601 transmits an encoded psychoacoustic frequency to the first decoder 602 and transmits an encoded sinusoidal amplitude to the second decoder 604.

The first decoder 602 decodes the encoded psychoacoustic frequency received from the parser 601. The first decoder 602 decodes the frequency in a decoding method corresponding to the encoding performed by the first encoder 105 illustrated in FIG. 1.

The inverse frequency converter 603 inverse-converts the decoded psychoacoustic frequency output from the first decoder 602 to a sinusoidal frequency. In detail, the inverse frequency converter 603 inverse-converts the decoded psychoacoustic frequency to a sinusoidal frequency using an inverse conversion method corresponding to the conversion performed by the frequency converter 104 illustrated in FIG. 1.

The second decoder 604 decodes the encoded sinusoidal amplitude received from the parser 601. The second decoder 604 decodes the amplitude in a decoding method corresponding to the encoding performed by the second encoder 106 illustrated in FIG. 1.

The phase detector 605 detects a sinusoidal phase based on the sinusoidal frequency input from the inverse frequency converter 603 and the decoded sinusoidal amplitude output from the second decoder 604. That is, the phase detector 605 can detect the sinusoidal phase using Formula 4.

$$sinusoidalphase = \phi_0 + \frac{(k_0 + k_1)}{2} \times \pi \tag{4}$$

In Formula 4, $\phi_0$ denotes a phase of a previously connected sinusoidal wave, and $k_0$ and $k_1$ respectively denote a frequency (frequency defined as bin) of the previously connected sinusoidal wave and a frequency (frequency defined as bin) of a current sinusoidal wave.

The audio signal decoder 606 decodes a sinusoidal wave based on the sinusoidal phase detected by the phase detector 605 and the sinusoidal amplitude and the sinusoidal frequency input via the phase detector 605, and decodes an audio signal using the decoded sinusoidal wave.

Figure 7:
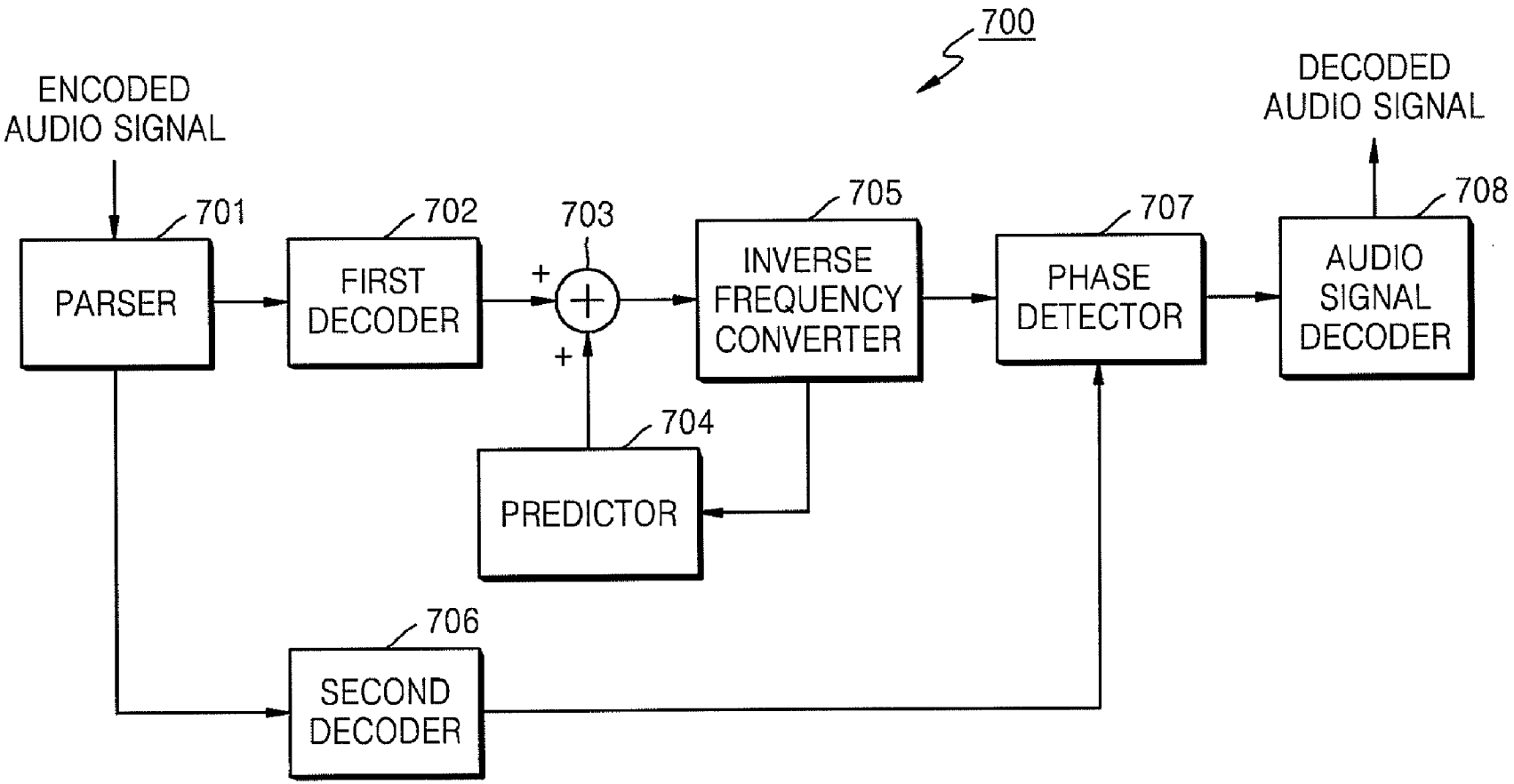
FIG. 7 is a block diagram of an audio decoding apparatus according to another exemplary embodiment of the present invention.

FIG. 7 is a block diagram of an audio decoding apparatus 700 according to another exemplary embodiment of the present invention. The audio decoding apparatus 700 illustrated in FIG. 7 includes a parser 701, a first decoder 702, an adder 703, a predictor 704, an inverse frequency converter 705, a second decoder 706, a phase detector 707, and an audio signal decoder 708. The audio decoding apparatus 700 illustrated in FIG. 7 corresponds to the audio encoding apparatus 300 illustrated in FIG. 3 and is an exemplary embodiment in which the prediction function is added to the audio decoding apparatus 600 illustrated in FIG. 6.

Thus, the parser 701, the first decoder 702, the second decoder 706, the phase detector 707, and the audio signal decoder 708, which are illustrated in FIG. 7, are configured and operate similarly to the parser 601, the first decoder 602, the second decoder 604, the phase detector 605, and the audio signal decoder 606, which are illustrated in FIG. 6.

Referring to FIG. 7, the adder 703 adds a predicted frequency to a decoded psychoacoustic frequency output from the first decoder 702 and transmits the adding result to the inverse frequency converter 705. The inverse frequency converter 705 inverse-converts the added frequency received from the adder 703 to a sinusoidal frequency. The sinusoidal frequency output from the inverse frequency converter 705 is transmitted to the phase detector 707.

The predictor 704 receives the frequency before the inverse conversion from the inverse frequency converter 705 and predicts a psychoacoustic frequency of a current segment by considering the frequency received from the inverse frequency converter 705 as a decoded psychoacoustic frequency of a previous segment. The prediction method can be similar to that of the predictor 307 illustrated in FIG. 3.

Figure 8:
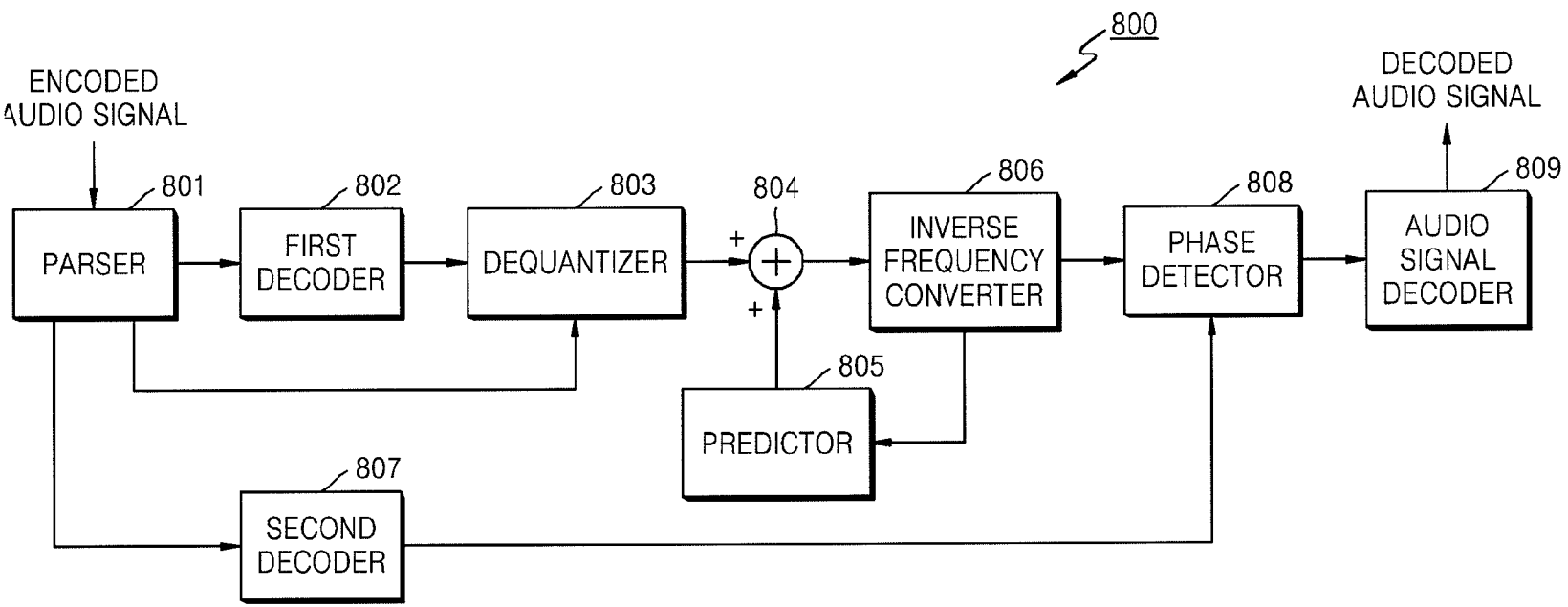
FIG. 8 is a block diagram of an audio decoding apparatus according to still another exemplary embodiment of the present invention.

FIG. 8 is a block diagram of an audio decoding apparatus 800 according to another exemplary embodiment of the present invention. The audio decoding apparatus 800 illustrated in FIG. 8 includes a parser 801, a first decoder 802, a dequantizer 803, an adder 804, a predictor 805, an inverse frequency converter 806, a second decoder 807, a phase detector 808, and an audio signal decoder 809. The audio decoding apparatus 800 illustrated in FIG. 8 corresponds to the audio encoding apparatus 400 illustrated in FIG. 4 and is an exemplary embodiment in which a dequantization function is added to the audio decoding apparatus 700 illustrated in FIG. 7.

Thus, the first decoder 802, the predictor 805, the inverse frequency converter 806, the second decoder 807, the phase detector 808, and the audio signal decoder 809, which are illustrated in FIG. 8, are configured and operate similarly to the first decoder 702, the predictor 704, the inverse frequency converter 705, the second decoder 706, the phase detector 707, and the audio signal decoder 708, which are illustrated in FIG. 7.

Referring to FIG. 8, the parser 801 parses an input encoded audio signal, transmits an encoded psychoacoustic frequency to the first decoder 802, transmits an encoded sinusoidal amplitude to the second decoder 807, and transmits quantization step size information contained as a control parameter of the encoded audio signal to the dequantizer 803.

The dequantizer 803 dequantizes a decoded psychoacoustic frequency received from the first decoder 802 based on the quantization step size. The adder 804 adds the dequantized psychoacoustic frequency output from the dequantizer 803 and a predicted frequency output from the predictor 805 and outputs the adding result.

Figure 9:
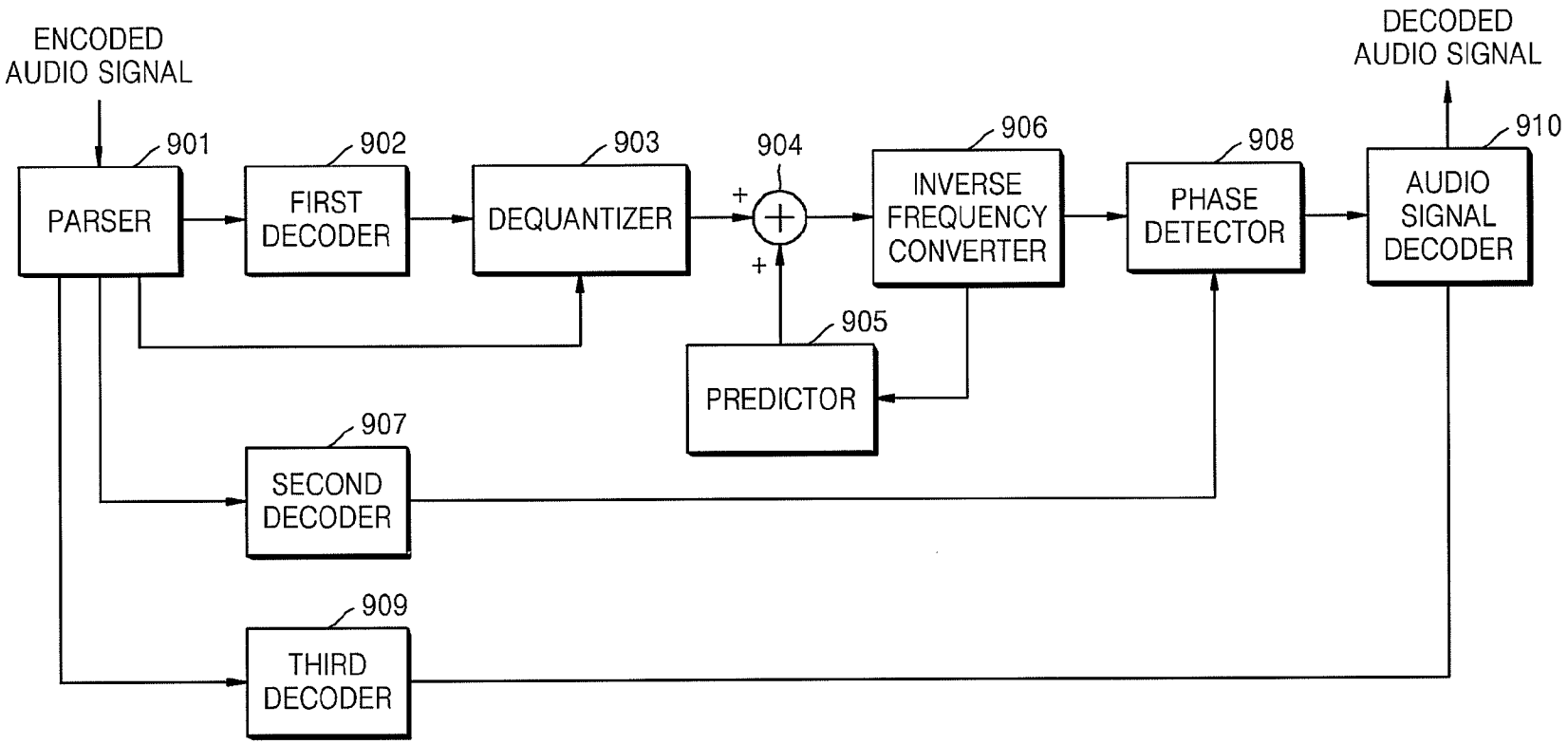
FIG. 9 is a block diagram of an audio decoding apparatus according to yet another exemplary embodiment of the present invention.

FIG. 9 is a block diagram of an audio decoding apparatus 900 according to another exemplary embodiment of the present invention. The audio decoding apparatus 900 illustrated in FIG. 9 includes a parser 901, a first decoder 902, a dequantizer 903, an adder 904, a predictor 905, an inverse frequency converter 906, a second decoder 907, a phase detector 908, a third decoder 909, and an audio signal decoder 910. The audio decoding apparatus 900 illustrated in FIG. 9 corresponds to the audio encoding apparatus 500 illustrated in FIG. 5 and is an exemplary embodiment in which a function of performing decoding by distinguishing sinusoidal waves connected to sinusoidal waves extracted from an audio signal of a previous segment from sinusoidal waves unconnected to the sinusoidal waves extracted from the audio signal of the previous segment is added to the audio decoding apparatus 800 illustrated in FIG. 8.

Thus, the first decoder 902, the dequantizer 903, the adder 904, the predictor 905, the inverse frequency converter 906, the second decoder 907, and the phase detector 908, which are illustrated in FIG. 9, are configured and operate similarly to the first decoder 802, the dequantizer 803, the adder 804, the predictor 805, the inverse frequency converter 806, the second decoder 807, and the phase detector 808, which are illustrated in FIG. 8.

Referring to FIG. 9, the parser 901 parses an input encoded audio signal, transmits an encoded psychoacoustic frequency to the first decoder 902, transmits an encoded sinusoidal amplitude to the second decoder 907, and transmits quantization step size information contained as a control parameter of the encoded audio signal to the dequantizer 903. If an encoded frequency, amplitude, and phase of a sinusoidal wave unconnected to a sinusoidal wave extracted from an audio signal of a previous segment are contained in the input encoded audio signal, the parser 901 transmits the encoded frequency, amplitude, and phase of the sinusoidal wave unconnected to the sinusoidal wave extracted from the audio signal of the previous segment to the third decoder 909.

The third decoder 909 decodes the encoded sinusoidal frequency, amplitude, and phase in a decoding method corresponding to the third encoder 511 illustrated in FIG. 5. The sinusoidal frequency, amplitude, and phase decoded by the third decoder 909 are transmitted to the audio signal decoder 910.

The audio signal decoder 910 decodes a sinusoidal wave based on the phase, amplitude, and frequency of each sinusoidal wave connected to the previous segment, which are received from the phase detector 908, and decodes a sinusoidal wave using the phase, amplitude, and frequency of each sinusoidal wave unconnected to the previous segment, which are received from the third decoder 909. The audio signal decoder 910 decodes an audio signal using the decoded sinusoidal waves. That is, the audio signal decoder 910 decodes an audio signal by combining the decoded sinusoidal waves.

The audio decoding apparatus 600 or 700 illustrated in FIG. 6 or 7 can be modified to further include the third decoder 909 illustrated in FIG. 9. If the audio decoding apparatus 600 or 700 illustrated in FIG. 6 or 7 further includes the third decoder 909, the parser 601 or 701 illustrated in FIG. 6 or 7 is implemented to parse an input encoded audio signal by checking whether a frequency, amplitude, and phase of a sinusoidal wave unconnected to a previous segment are contained in the input encoded audio signal, as in the parser 901 illustrated in FIG. 9.

Figure 10:
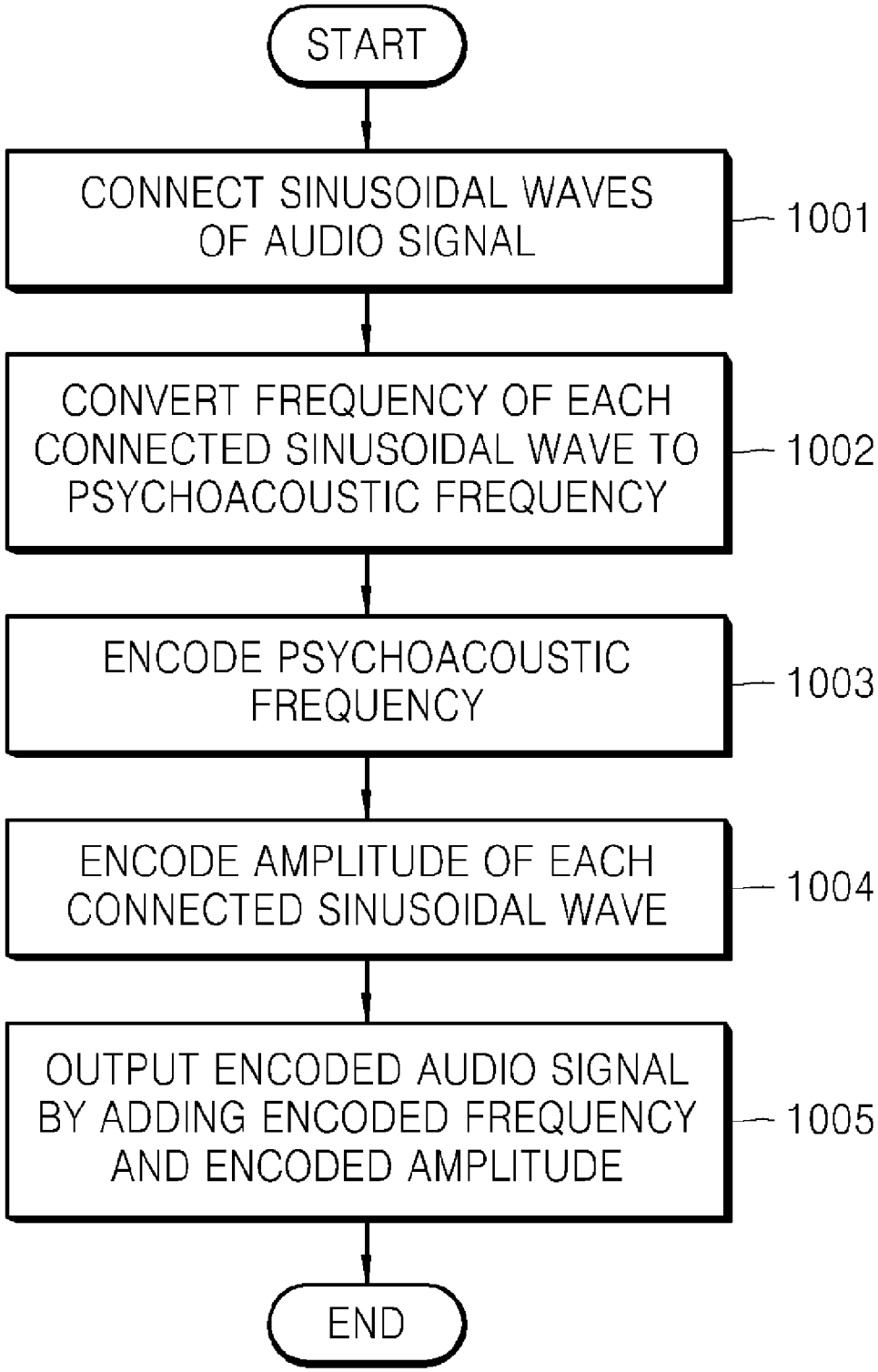
FIG. 10 is a flowchart of an audio encoding method according to an exemplary embodiment of the present invention.

FIG. 10 is a flowchart of an audio encoding method according to an exemplary embodiment of the present invention. The audio encoding method illustrated in FIG. 10 will now be described with reference to FIG. 1.

Sinusoidal waves extracted from an input audio signal are connected in operation 1001. The connection of the sinusoidal waves is performed as described with respect to the sinusoidal wave connector 103 illustrated in FIG. 1.

A frequency of each of the connected sinusoidal waves is converted to a psychoacoustic frequency in operation 1002 as in the frequency converter 104 illustrated in FIG. 1. The psychoacoustic frequency is encoded in operation 1003 as in the first encoder 105 illustrated in FIG. 1. An amplitude of each of the sinusoidal waves connected in operation 1001 is encoded in operation 1004 as in the second encoder 106 illustrated in FIG. 1. An encoded audio signal is output in operation 1005 by adding the frequency encoded in operation 1003 and the amplitude encoded in operation 1004.

Figure 11:
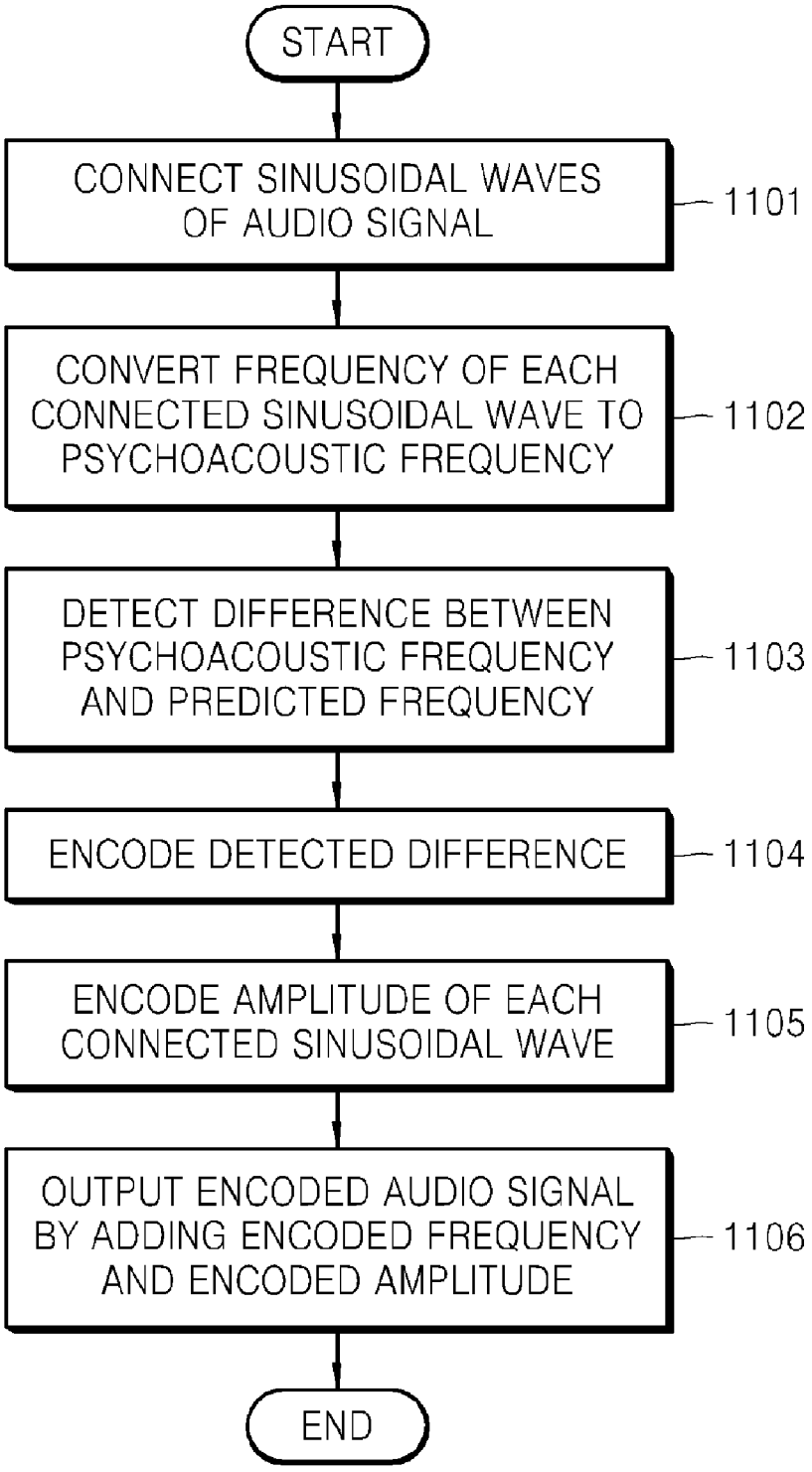
FIG. 11 is a flowchart of an audio encoding method according to another exemplary embodiment of the present invention.

FIG. 11 is a flowchart of an audio encoding method according to another exemplary embodiment of the present invention. The audio encoding method illustrated in FIG. 11 is an exemplary embodiment in which the prediction function is added to the audio encoding method illustrated in FIG. 10. Thus, operations 1101, 1102, and 1105 of FIG. 11 are respectively similar to operations 1001, 1002, and 1004 of FIG. 10.

Referring to FIG. 11, a difference between a psychoacoustic frequency and a predicted frequency is detected in operation 1103. The predicted frequency is predicted based on a psychoacoustic frequency of a previous segment as in the predictor 307 illustrated in FIG. 3.

The detected difference is encoded in operation 1104 as in the first encoder 306 illustrated in FIG. 3. An encoded audio signal is output in operation 1106 by adding the encoded difference and an encoded sinusoidal amplitude.

Figure 12:
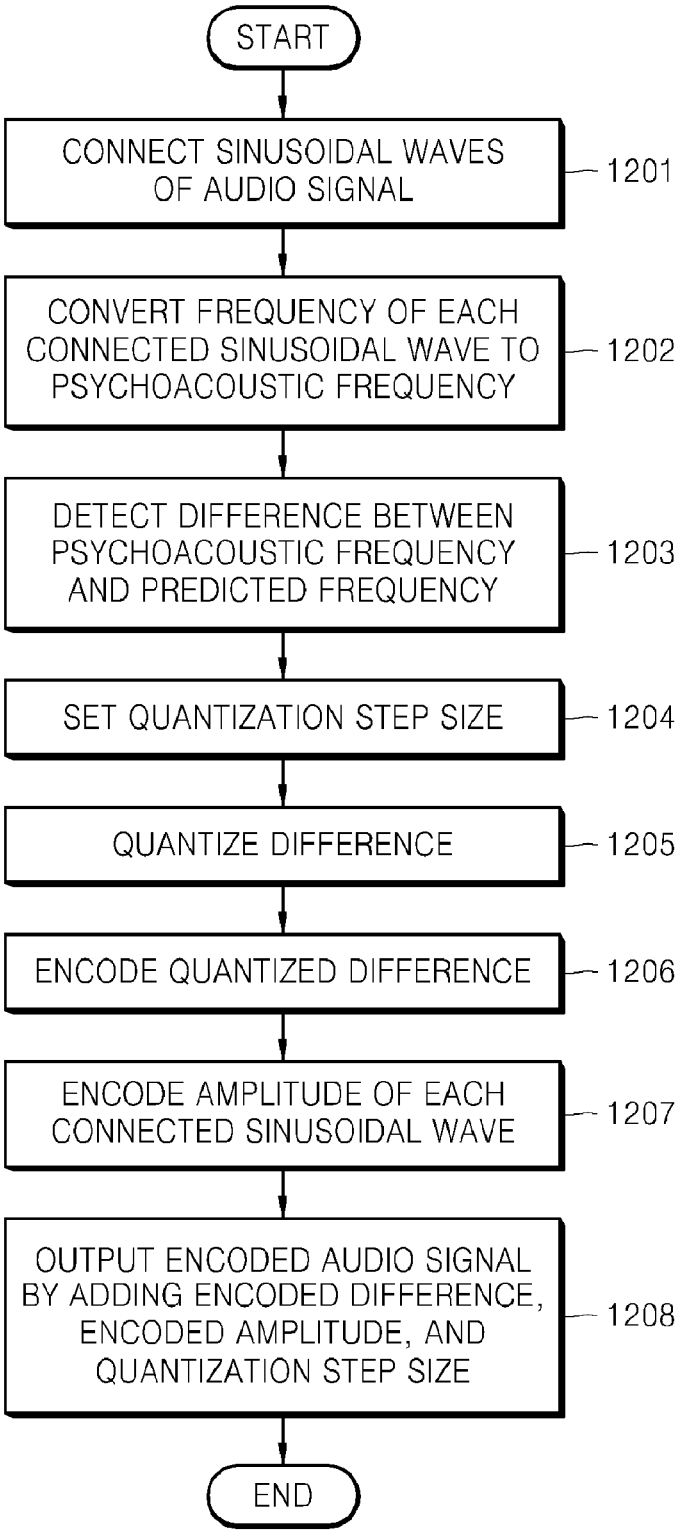
FIG. 12 is a flowchart of an audio encoding method according to still another exemplary embodiment of the present invention.

FIG. 12 is a flowchart of an audio encoding method according to another exemplary embodiment of the present invention. The audio encoding method illustrated in FIG. 12 is an exemplary embodiment in which the quantization function is added to the audio encoding method illustrated in FIG. 11. Thus, operations 1201, 1202, 1203, and 1207 of FIG. 12 are respectively similar to operations 1101, 1102, 1103, and 1105 of FIG. 11.

Referring to FIG. 12, a quantization step size is set in operation 1204. The quantization step size is set in the method described in the masking level provider 408 and the quantizer 406 illustrated in FIG. 4.

A difference detected in operation 1203 is quantized using the quantization step size in operation 1205. The quantized difference is encoded in operation 1206.

When the encoded difference and an encoded amplitude are added with each other, the quantization step size information acts as a control parameter of an encoded audio signal in operation 1208. Thus, the encoded audio signal contains the quantization step size information as a control parameter.

Figure 13:
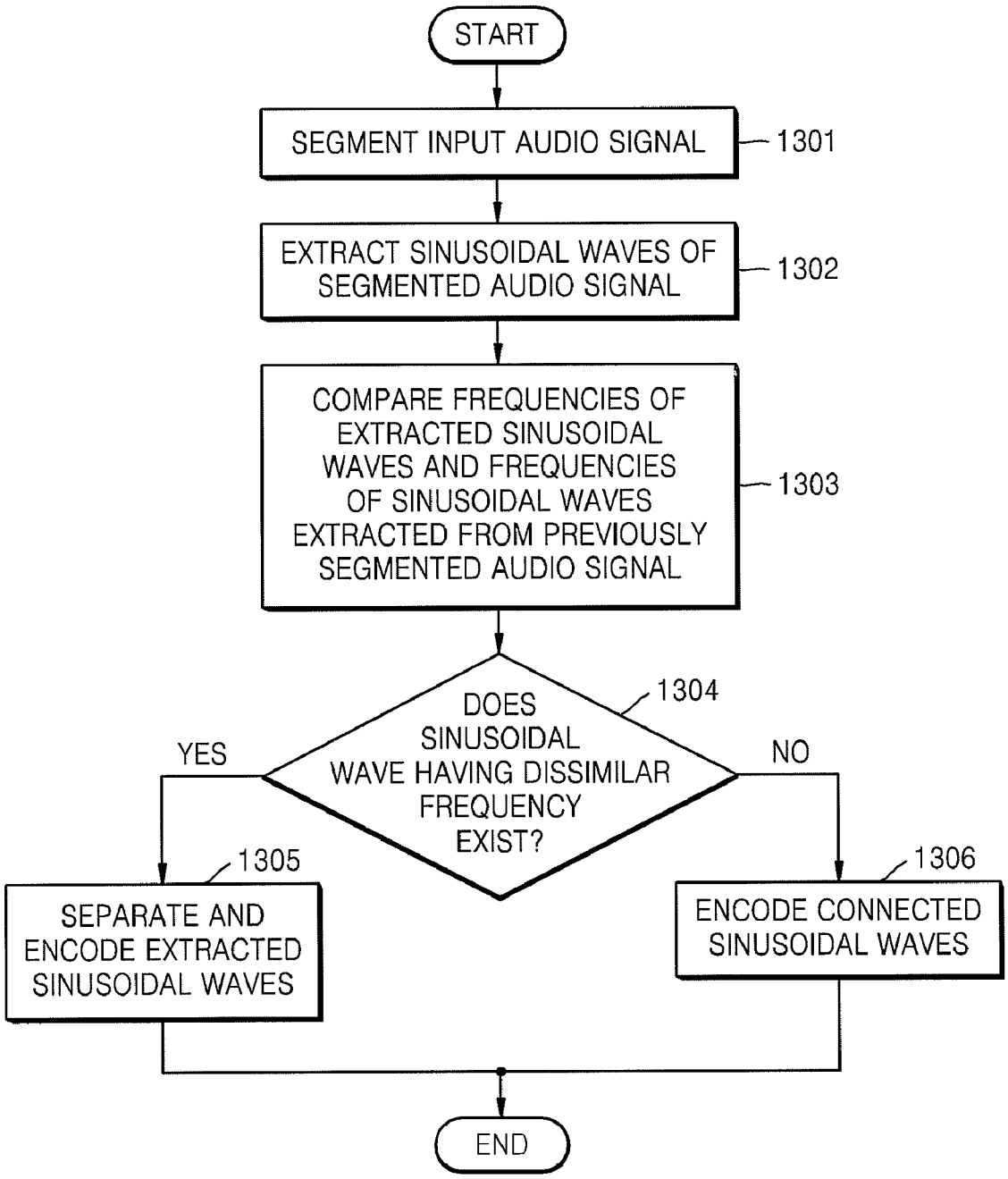
FIG. 13 is a flowchart of an audio encoding method according to yet another exemplary embodiment of the present invention.

FIG. 13 is a flowchart of an audio encoding method according to another exemplary embodiment of the present invention. The audio encoding method illustrated in FIG. 13 is an exemplary embodiment in which when sinusoidal waves are extracted by segmenting an input audio signal by a specific length, the audio signal is encoded by checking whether each of the extracted sinusoidal waves can be connected to a sinusoidal wave extracted from a previous segment.

Referring to FIG. 13, an input audio signal is segmented by a specific length in operation 1301 as in the segmentation unit 101 illustrated in FIG. 1. Sinusoidal waves of a segmented audio signal are extracted in operation 1302 as in the sinusoidal wave extractor 102 illustrated in FIG. 1.

Frequencies of the extracted sinusoidal waves are compared to frequencies of sinusoidal waves extracted from an audio signal of a previous segment in operation 1303. The number of sinusoidal waves extracted from an audio signal of a current segment may be different from the number of sinusoidal waves extracted from an audio signal of a previous segment.

If at least one of the sinusoidal waves extracted from the audio signal of the current segment has a frequency that is not similar to the frequency of any sinusoidal wave extracted from the audio signal of the previous segment, in operation 1304 as a result of the comparison, sinusoidal waves connected to the sinusoidal waves extracted from the audio signal of the previous segment and sinusoidal waves unconnected to the sinusoidal waves extracted from the audio signal of the previous segment are separated from the sinusoidal waves extracted in operation 1302 and the separated sinusoidal waves are encoded in operation 1305.

For checking the similarity of sinusoidal waves, when frequencies of sinusoidal waves extracted from an audio signal of a current segment are, for example, 20 Hz, 30 Hz, and 35 Hz, and when a pre-set acceptable error range is ±0.2, if all the frequencies in the ranges (20±0.2) Hz, (30±0.2) Hz, and (35±0.2) Hz exist among frequencies of sinusoidal waves extracted from an audio signal of a previous segment, all the frequencies of the sinusoidal waves extracted from the audio signal of the current segment are similar to the frequencies of the sinusoidal waves extracted from the audio signal of the previous segment. If frequencies in the range (20±0.2) Hz do not exist among the frequencies of the sinusoidal waves extracted from the audio signal of the previous segment, the frequency of a 20-Hz sinusoidal wave among the sinusoidal waves extracted from the audio signal of the current segment is not similar to the frequency of any sinusoidal wave extracted from the audio signal of the previous segment. Thus, the sinusoidal wave having the frequency of 20 Hz extracted from the audio signal of the current segment is separated as a sinusoidal wave that is unconnected to the previous segment, and the sinusoidal waves having the frequencies of 30 Hz and 35 Hz are separated as sinusoidal waves that are connected to the previous segment.

The sinusoidal waves connected to the previous segment are encoded by sequentially performing operations 1001 through 1004 illustrated in FIG. 10, operations 1101 through 1105 illustrated in FIG. 11, or operations 1201 through 1207 illustrated in FIG. 12, and the sinusoidal waves unconnected to the previous segment are encoded as in the third encoder 511 illustrated in FIG. 5. An encoded audio signal is output by adding the result obtained by encoding the sinusoidal waves connected to the previous segment and the result obtained by encoding the sinusoidal waves unconnected to the previous segment.

In operation 1304 as a result of the comparison, if all the sinusoidal waves extracted from the audio signal of the current segment have a frequency that is similar to the frequency of any sinusoidal wave extracted from the audio signal of the previous segment, in operation 1306, the sinusoidal waves connected to the previous segment are encoded by sequentially performing operations 1001 through 1005 illustrated in FIG. 10, operations 1101 through 1106 illustrated in FIG. 11, or operations 1201 through 1208 illustrated in FIG. 12.

Figure 14:
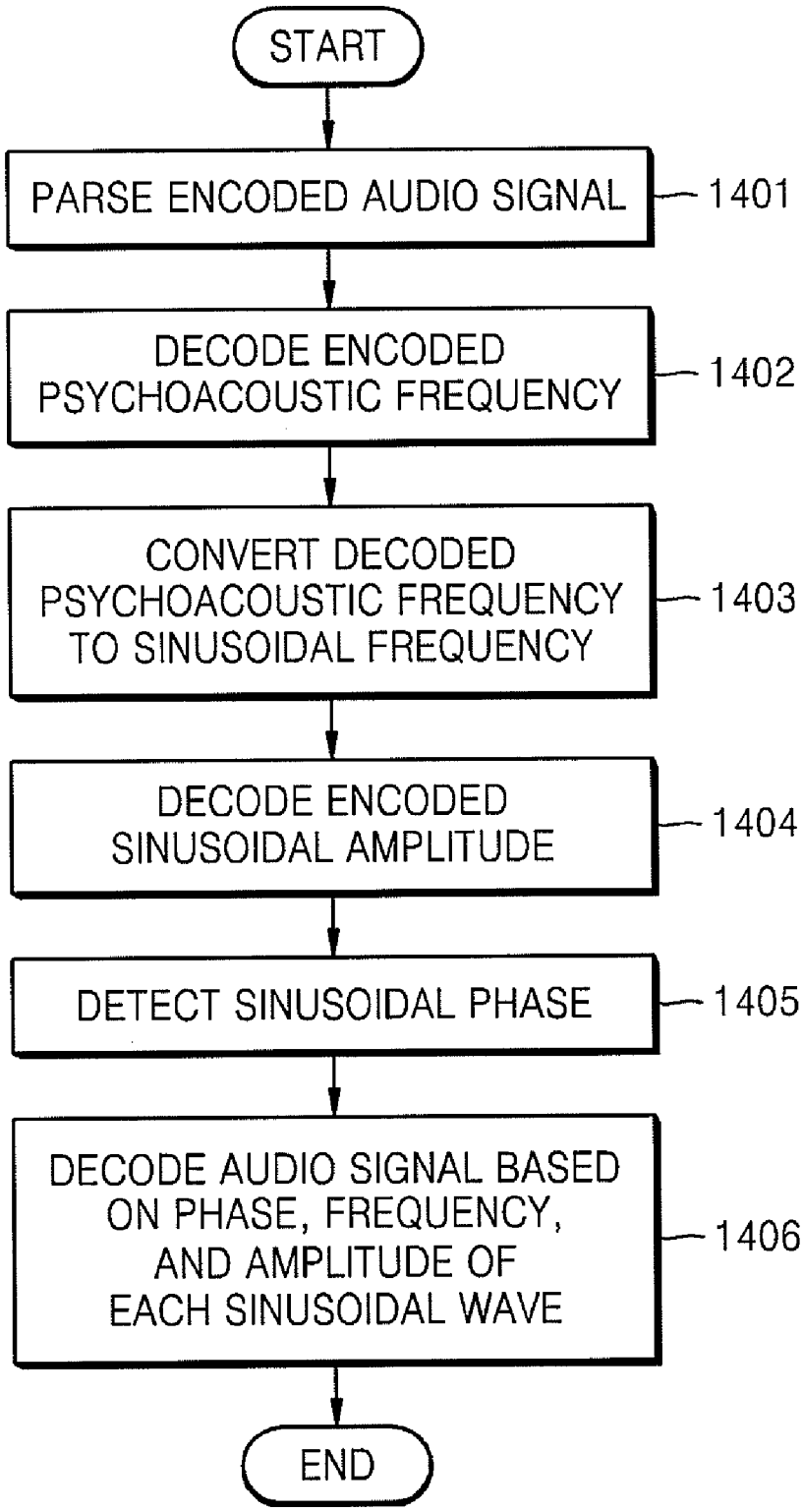
FIG. 14 is a flowchart of an audio decoding method according to an exemplary embodiment of the present invention.

FIG. 14 is a flowchart of an audio decoding method according to an exemplary embodiment of the present invention. Referring to FIG. 14, an encoded psychoacoustic frequency and an encoded sinusoidal amplitude are detected by parsing an encoded audio signal in operation 1401. The encoded psychoacoustic frequency is decoded in operation 1402, and the decoded psychoacoustic frequency is converted to a sinusoidal frequency in operation 1403 as in the inverse frequency converter 603 illustrated in FIG. 6.

The encoded sinusoidal amplitude is decoded in operation 1404. A sinusoidal phase is detected based on the decoded sinusoidal amplitude and the sinusoidal frequency in operation 1405. A sinusoidal wave is decoded based on the detected sinusoidal phase, the decoded sinusoidal amplitude, and the sinusoidal frequency, and an audio signal is decoded using the decoded sinusoidal wave in operation 1406.

Figure 15:
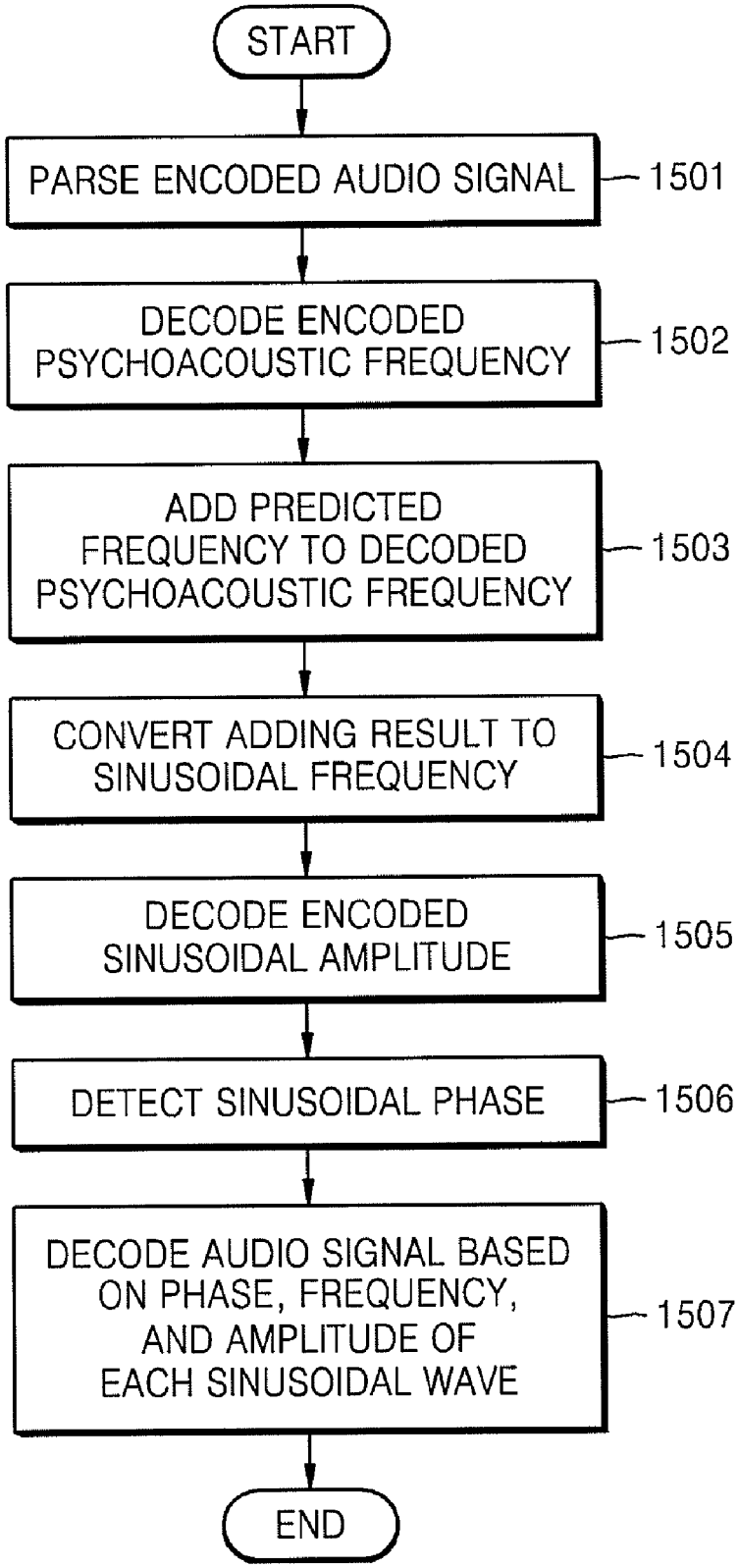
FIG. 15 is a flowchart of an audio decoding method according to another exemplary embodiment of the present invention.

FIG. 15 is a flowchart of an audio decoding method according to another exemplary embodiment of the present invention. The audio decoding method illustrated in FIG. 15 is an exemplary embodiment in which the prediction function is added to the audio decoding method illustrated in FIG. 14. Thus, operations 1501, 1502, 1505, 1506, and 1507 of FIG. 15 are respectively similar to operations 1401, 1402, 1404, 1405, and 1406 of FIG. 14.

Referring to FIG. 15, in operation 1503, a frequency predicted based on a decoded psychoacoustic frequency of a previous segment is added to a psychoacoustic frequency decoded in operation 1502. The adding result is converted to a sinusoidal frequency in operation 1504.

Figure 16:
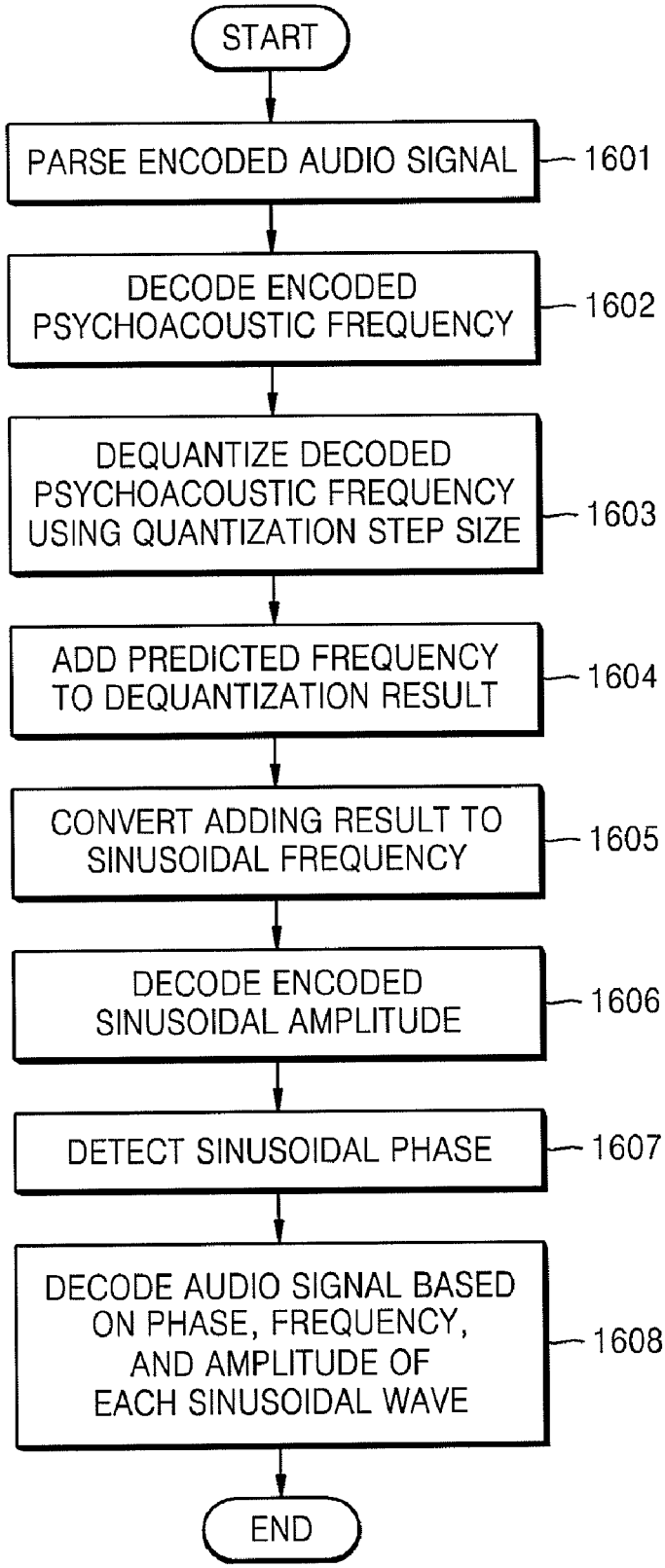
FIG. 16 is a flowchart of an audio decoding method according to still another exemplary embodiment of the present invention.

FIG. 16 is a flowchart of an audio decoding method according to another exemplary embodiment of the present invention. The audio decoding method illustrated in FIG. 16 is an exemplary embodiment in which the dequantization function is added to the audio decoding method illustrated in FIG. 15. Thus, operations 1601, 1602, 1605, 1606, 1607, and 1608 of FIG. 16 are respectively similar to operations 1501, 1502, 1504, 1505, 1506, and 1507 of FIG. 15.

Referring to FIG. 16, a decoded psychoacoustic frequency is dequantized using a quantization step size in operation 1603. The quantization step size is detected from an encoded audio signal when the encoded audio signal is parsed in operation 1601. The dequantization result is added to a predicted frequency in operation 1604.

Figure 17:
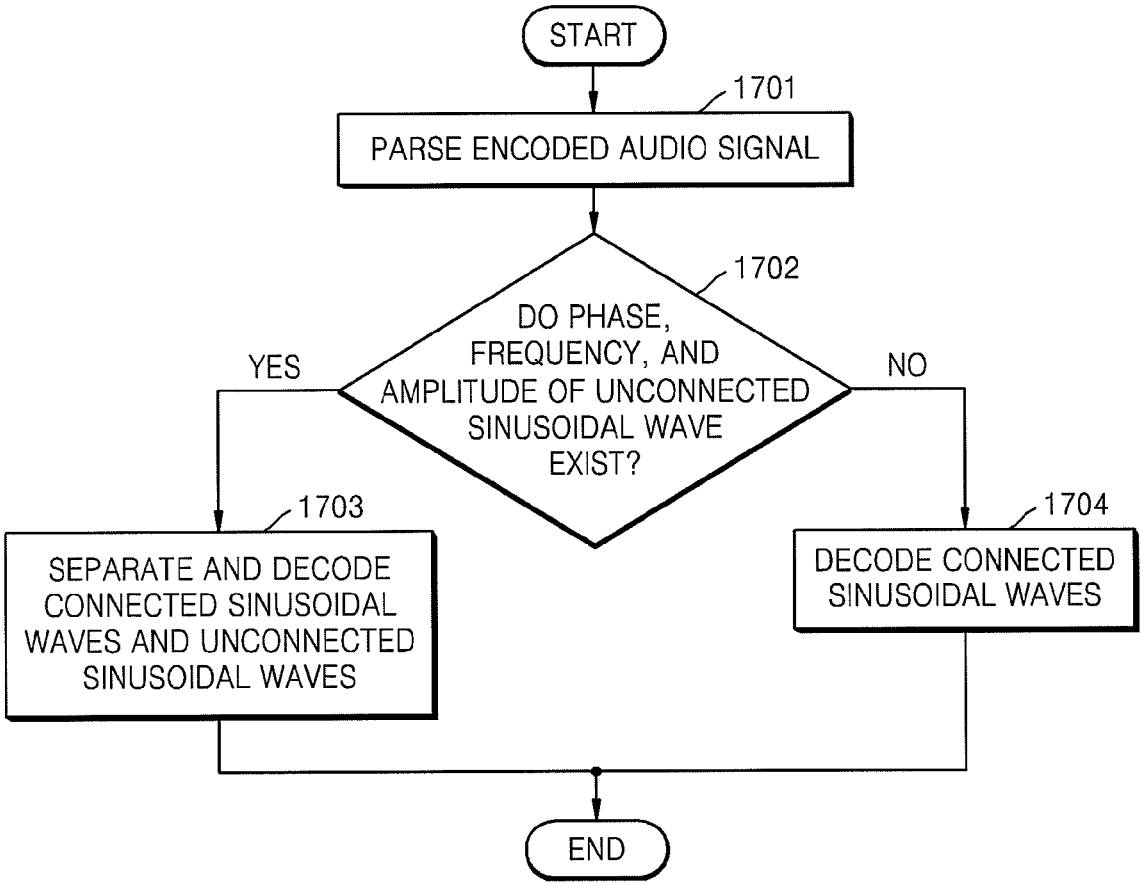
FIG. 17 is a flowchart of an audio decoding method according to yet another exemplary embodiment of the present invention.

FIG. 17 is a flowchart of an audio decoding method according to another exemplary embodiment of the present invention. The audio decoding method illustrated in FIG. 17 is an exemplary embodiment in which when an encoded audio signal is decoded, sinusoidal waves connected to sinusoidal waves extracted from an audio signal of a previous segment and sinusoidal waves unconnected to the sinusoidal waves extracted from the audio signal of the previous segment are separated and decoded.

Referring to FIG. 17, an encoded audio signal is parsed in operation 1701. It is determined in operation 1702 whether a sinusoidal wave unconnected to any sinusoidal wave extracted from an audio signal of a previous segment (hereinafter, an unconnected sinusoidal wave) exists. That is, if a frequency, amplitude, and phase of the unconnected sinusoidal wave exist in the encoded audio signal, it is determined that the unconnected sinusoidal wave exists in the encoded audio signal.

If unconnected sinusoidal waves exist in the encoded audio signal, the unconnected sinusoidal waves and sinusoidal waves connected to the sinusoidal waves extracted from the audio signal of the previous segment (hereinafter, connected sinusoidal waves) are separated from the encoded audio signal and decoded in operation 1703.

That is, in operation 1703, the unconnected sinusoidal waves and the connected sinusoidal waves are separated by parsing the encoded audio signal, a frequency, amplitude, and phase of each connected sinusoidal wave are detected by sequentially performing operations 1402 through 1405 of FIG. 14, operations 1502 through 1506 of FIG. 15, or operations 1602 through 1607 of FIG. 16, and a frequency, amplitude, and phase of each unconnected sinusoidal wave are detected by performing decoding as in the third decoder 909 illustrated in FIG. 9. The connected sinusoidal waves are decoded based on the frequency, amplitude, and phase of each connected sinusoidal wave, the unconnected sinusoidal waves are decoded based on the frequency, amplitude, and phase of each unconnected sinusoidal wave, and an audio signal is decoded by combining the decoded connected sinusoidal waves and the decoded unconnected sinusoidal waves.

If no unconnected sinusoidal wave exists in the encoded audio signal as a result of the determination of operation 1702, the connected sinusoidal waves are decoded in operation 1704. The decoding of the connected sinusoidal waves is performed by a similar method to that performed in operation 1703 for the connected sinusoidal waves.

The invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices. The computer readable recording medium can also be distributed over network coupled computer systems so that the computer readable code is stored and executed in a distributed fashion.

As described above, according to the present invention, when sinusoidal waves of an audio signal are connected and encoded, by converting a frequency of each connected sinusoidal wave to a psychoacoustic frequency and encoding the psychoacoustic frequency, a compression ratio of the audio signal can be increased while maintaining sound quality of the audio signal.

In addition, by encoding a difference between the psychoacoustic frequency and a predicted frequency, the compression ratio of the audio signal can be further increased, and by setting a quantization step size using a masking level calculated using a psychoacoustic model and an amplitude of each connected sinusoidal wave and encoding the difference using the set quantization step size, the compression ratio of the audio signal can be increased much more.

If at least one sinusoidal wave extracted from a currently segmented audio signal has a frequency that is not similar to a frequency of any sinusoidal wave extracted from a previously segmented audio signal, by separating sinusoidal waves connected to the sinusoidal waves extracted from the previously segmented audio signal and sinusoidal waves unconnected to the sinusoidal waves extracted from the previously segmented audio signal from the sinusoidal waves extracted from the currently segmented audio signal and encoding the separated sinusoidal waves, degradation of sound quality due to incorrect encoding can be prevented.

While this invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. An audio encoding method comprising:

connecting sinusoidal waves of an input audio signal;

converting a frequency of one of the connected sinusoidal waves to a psychoacoustic frequency;

performing a first encoding operation for encoding the psychoacoustic frequency;

performing a second encoding operation for encoding an amplitude of the one of the connected sinusoidal waves; and outputting an encoded audio signal by adding an encoding result of the first encoding operation and an encoding result of the second encoding operation.

2. The audio encoding method of claim 1, further comprising:

segmenting the input audio signal by a specific length to generate segmented audio signals;

extracting sinusoidal waves from one of the segmented audio signals; and comparing frequencies of the extracted sinusoidal waves and frequencies of sinusoidal waves extracted from a previous segment of the segmented audio signals;

wherein if at least one sinusoidal wave among the extracted sinusoidal waves has a frequency that is not similar to any of the frequencies of the sinusoidal waves extracted from the previous segment as a result of the comparison, separating sinusoidal waves connected to the sinusoidal waves extracted from the previous segment and sinusoidal waves unconnected to the sinusoidal waves extracted from the previous segment from the extracted sinusoidal waves, to generate separated sinusoidal waves, and encoding the separated sinusoidal waves, wherein the connecting of the sinusoidal waves, the converting of the frequency, the first encoding operation, the second encoding operation, and the outputting of the encoded audio signal are sequentially performed for the connected sinusoidal waves, and wherein if the extracted sinusoidal waves have a frequency similar to any of the frequencies of the sinusoidal waves extracted from the audio signal of the previous segment as a result of the comparison, the connecting of the sinusoidal waves, the converting of the frequency, the first encoding operation, the second encoding operation, and the outputting of the encoded audio signal are sequentially performed for the extracted sinusoidal waves.

3. An audio encoding method comprising:

connecting sinusoidal waves of an input audio signal;

converting a frequency of one of the connected sinusoidal waves to a psychoacoustic frequency;

detecting a difference between the psychoacoustic frequency and a frequency predicted based on a psychoacoustic frequency of a previous segment of audio signal;

performing a first encoding operation for encoding the difference;

performing a second encoding operation for encoding an amplitude of the one of the connected sinusoidal waves; and outputting an encoded audio signal by adding an encoding result of the first encoding operation and an encoding result of the second encoding operation.

4. An audio encoding method comprising:

connecting sinusoidal waves of an input audio signal;

converting a frequency of one of the connected sinusoidal waves to a psychoacoustic frequency;

detecting a difference between the psychoacoustic frequency and a frequency predicted based on a psychoacoustic frequency of a previous segment of audio signal;

setting a quantization step size based on a masking level calculated using a psychoacoustic model of the input audio signal and amplitudes of the connected sinusoidal waves;

quantizing the difference using the set quantization step size, performing a first encoding operation for encoding the quantized difference;

performing a second encoding operation for encoding the amplitudes of the one of the connected sinusoidal waves; and outputting an encoded audio signal by adding an encoding result of the first encoding operation and an encoding result of the second encoding operation wherein the outputting of the encoded audio signal comprises outputting information on the quantization step size by processing the quantization step size as a control parameter.

5. The audio encoding method of claim 4, wherein the setting of the quantization step size comprises setting the quantization step size to be small if each of the amplitudes of the connected sinusoidal waves is greater than the masking level, and setting the quantization step size to be large if each of the amplitudes of the connected sinusoidal waves is not greater than the masking level.

6. An audio decoding method comprising:

detecting an encoded psychoacoustic frequency and an encoded sinusoidal amplitude by parsing an encoded audio signal;

performing a first decoding operation for decoding the encoded psychoacoustic frequency;

converting the decoded psychoacoustic frequency to a sinusoidal frequency;

performing a second decoding operation for decoding the encoded sinusoidal amplitude;

detecting a sinusoidal phase based on the decoded sinusoidal amplitude and the sinusoidal frequency; and decoding a sinusoidal wave based on the detected sinusoidal phase, the decoded sinusoidal amplitude, and the sinusoidal frequency and decoding an audio signal using the decoded sinusoidal wave.

7. The audio decoding method of claim 6, further comprising:

separating sinusoidal waves connected to the sinusoidal waves extracted from a previous segment of audio signal and sinusoidal waves unconnected to the sinusoidal waves extracted from the previous segment, if at least one sinusoidal wave unconnected to sinusoidal waves extracted from the previous segment exists in the encoded audio signal as a result of parsing the encoded audio signal;

performing a first detection operation for detecting an amplitude, frequency, and phase of each of the connected sinusoidal waves by sequentially performing detecting, the first decoding operation, the converting, the second decoding operation, and the detecting of the sinusoidal phase; and performing a second detection operation for detecting an amplitude, frequency, and phase of each of the unconnected sinusoidal waves by decoding each of the unconnected sinusoidal waves, wherein the decoding of the audio signal comprises decoding sinusoidal waves based on amplitudes, frequencies, and phases of the sinusoidal waves detected in the first detection operation and the second detection operation, and decoding the audio signal using the decoded sinusoidal waves.

8. An audio decoding method comprising:

detecting an encoded psychoacoustic frequency and an encoded sinusoidal amplitude by parsing an encoded audio signal;

performing a first decoding operation for decoding the encoded psychoacoustic frequency;

adding the decoded psychoacoustic frequency to a frequency predicted based on a decoded psychoacoustic frequency of a previous segment of audio signal, to generate an adding result;

converting the adding result to a sinusoidal frequency;

performing a second decoding operation for decoding the encoded sinusoidal amplitude;

detecting a sinusoidal phase based on the decoded sinusoidal amplitude and the sinusoidal frequency; and decoding a sinusoidal wave based on the detected sinusoidal phase, the decoded sinusoidal amplitude, and the sinusoidal frequency and decoding an audio signal using the decoded sinusoidal wave.

9. An audio decoding method comprising:

detecting an encoded psychoacoustic frequency and an encoded sinusoidal amplitude by parsing an encoded audio signal;

performing a first decoding operation for decoding the encoded psychoacoustic frequency;

detecting a quantization step size by parsing the encoded audio signal;

dequantizing the decoded psychoacoustic frequency using the detected quantization step size, to generate a dequantizing result;

adding the dequantizing result to a frequency predicted based on a decoded psychoacoustic frequency of a previous segment of audio signal, to generate an adding result;

converting the adding result to a sinusoidal frequency;

performing a second decoding operation for decoding the encoded sinusoidal amplitude;

detecting a sinusoidal phase based on the decoded sinusoidal amplitude and the sinusoidal frequency; and decoding a sinusoidal wave based on the detected sinusoidal phase, the decoded sinusoidal amplitude and the sinusoidal frequency, and decoding an audio signal using the decoded sinusoidal wave.

10. An audio encoding apparatus comprising:

a segmentation unit which segments an input audio signal by a specific length to generate segmented audio signals;

a sinusoidal wave extractor which extracts at least one sinusoidal wave from a segment of the segmented audio signals output from the segmentation unit;

a sinusoidal wave connector which connects the at least one sinusoidal wave extracted by the sinusoidal wave extractor;

a frequency converter which converts a frequency of one of the connected sinusoidal waves to a psychoacoustic frequency;

a first encoder which encodes the psychoacoustic frequency;

a second encoder which encodes an amplitude of the one of the connected sinusoidal waves; and a adder which outputs an encoded audio signal by adding an encoding result encoded by the first encoder and an encoding result encoded by the second encoder.

11. The audio encoding apparatus of claim 10, wherein the sinusoidal wave connector compares frequencies of the extracted sinusoidal waves and frequencies of sinusoidal waves extracted from a previous segment of the segmented audio signals, and encodes a frequency, amplitude, and phase of each of the sinusoidal waves having a frequency which is not similar to any of the frequencies of the sinusoidal waves extracted from the audio signal at the previous segment.

12. An audio encoding apparatus comprising:

a segmentation unit which segments an input audio signal by a specific length to generate segmented audio signals;

a sinusoidal wave extractor which extracts at least one sinusoidal wave from a segment of the segmented audio signals output from the segmentation unit;

a sinusoidal wave connector which connects the at least one sinusoidal wave extracted by the sinusoidal wave extractor;

a frequency converter which converts a frequency of one of the connected sinusoidal waves to a psychoacoustic frequency;

a predictor which predicts a frequency based on a psychoacoustic frequency of a previous segment of the segmented audio signals; and a difference detector which detects a difference between the frequency predicted by the predictor and the psychoacoustic frequency input from the frequency converter;

a first encoder which encodes the difference;

a second encoder which encodes an amplitude of the one of the connected sinusoidal waves; and a adder which outputs an encoded audio signal by adding an encoding result encoded by the first encoder and an encoding result encoded by the second encoder.

13. An audio encoding apparatus comprising:

a segmentation unit which segments an input audio signal by a specific length to generate segmented audio signals;

a sinusoidal wave extractor which extracts at least one sinusoidal wave from a segment of the segmented audio signals output from the segmentation unit;

a sinusoidal wave connector which connects the at least one sinusoidal wave extracted by the sinusoidal wave extractor;

a frequency converter which converts a frequency of one of the connected sinusoidal waves to a psychoacoustic frequency;

a predictor which predicts a frequency based on a psychoacoustic frequency of a previous segment of the segmented audio signals; and a difference detector which detects a difference between the frequency predicted by the predictor and the psychoacoustic frequency input from the frequency converter;

a masking level provider which provides a masking level calculated using a psychoacoustic model of the segmented audio signals output from the segmentation unit;

a quantizer which sets a quantization step size based on amplitudes of the connected sinusoidal waves output from the sinusoidal wave connector and the masking level, quantizes a signal output from the difference detector using the set quantization step size, and transmits the signal output from the difference detector to the predictor as a psychoacoustic frequency of a previous segment of the segmented audio signals;

a first encoder which encodes a quantized signal output from the quantizer;

a second encoder which encodes an amplitude of the one of the connected sinusoidal waves; and a adder which outputs an encoded audio signal by adding an encoding result encoded by the first encoder and an encoding result encoded by the second encoder, wherein the adder adds the quantization step size output from the quantizer as a control parameter of the encoded audio signal.

14. The audio encoding apparatus of claim 13, wherein the quantizer sets the quantization step size to be small if each of the amplitudes of the connected sinusoidal waves is greater than the masking level, and sets the quantization step size to be large if each of the amplitudes of the connected sinusoidal waves is not greater than the masking level.

15. An audio decoding apparatus comprising:

a parser which parses an encoded audio signal;

a first decoder which decodes an encoded psychoacoustic frequency output from the parser;

an inverse frequency converter which converts the decoded psychoacoustic frequency to a sinusoidal frequency;

a second decoder which decodes an encoded sinusoidal amplitude output from the parser;

a phase detector which detects a sinusoidal phase based on the decoded sinusoidal amplitude and the sinusoidal frequency; and an audio decoder which decodes a sinusoidal wave based on the detected sinusoidal phase, the decoded sinusoidal amplitude and the sinusoidal frequency, and decodes the audio signal using the decoded sinusoidal wave.

16. The audio decoding apparatus of claim 15, further comprising a third decoder which decodes an encoded frequency, amplitude and phase of a sinusoidal wave unconnected to sinusoidal waves extracted from an audio signal of a previous segment of audio signal if the encoded frequency, amplitude, and phase of the sinusoidal wave unconnected to the sinusoidal waves extracted from the previous segment of audio signal are output from the parser, wherein the audio signal decoder decodes sinusoidal waves based on amplitudes, frequencies and phases of the sinusoidal waves decoded by the third decoder, and decodes the audio signal using the decoded sinusoidal waves.

17. An audio decoding apparatus comprising:

a parser which parses an encoded audio signal;

a first decoder which decodes an encoded psychoacoustic frequency output from the parser;

a predictor which predicts a frequency based on a decoded psychoacoustic frequency of a previous segment of audio signal; and an adder which adds the decoded psychoacoustic frequency output from the first decoder to the predicted frequency output from the predictor to generate an adding result;

an inverse frequency converter which converts the adding result to a sinusoidal frequency;

a second decoder which decodes an encoded sinusoidal amplitude output from the parser;

a phase detector which detects a sinusoidal phase based on the decoded sinusoidal amplitude and the sinusoidal frequency; and an audio decoder which decodes a sinusoidal wave based on the detected sinusoidal phase, the decoded sinusoidal amplitude and the sinusoidal frequency, and decodes an audio signal using the decoded sinusoidal wave.

18. The audio decoding apparatus of claim 17, further comprising a dequantizer which dequantizes the decoded psychoacoustic frequency output from the first decoder using a quantization step size output from the parser, wherein the adder adds the dequantization result output from the dequantizer to the predicted frequency.

* * * * *